US005478084A

United States Patent [19]

Itkis

[11] Patent Number: 5,478,084

[45] Date of Patent: Dec. 26, 1995

[54] MAGNETIC BINGO BOARD

[76] Inventor: Yuri Itkis, 8620 Lakeridge Cir., Las Vegas, Nev. 89117

[21] Appl. No.: 67,554

[22] Filed: May 23, 1993

Related U.S. Application Data

[63] Continuation-in-part of Ser. No. 992,651, Dec. 18, 1992, abandoned.

[51] Int. Cl.[6] ..... A63F 9/24; A63F 3/06

[52] U.S. Cl. ..... 273/239; 273/269; 434/409

[58] Field of Search ..... 273/237, 238, 273/239, 240, 269, 270; 434/409, 410

[56] References Cited

U.S. PATENT DOCUMENTS

| | | | |
|---|---|---|---|
| 3,012,787 | 12/1961 | Ertel | 273/270 |
| 4,143,472 | 3/1979 | Murata et al. | 434/409 |
| 4,212,468 | 7/1980 | Knott | 273/269 |
| 4,343,474 | 8/1982 | Caney | 273/240 |
| 4,354,845 | 10/1982 | Poteet et al. | 273/240 |
| 4,365,810 | 12/1982 | Richardson | 273/269 |
| 4,398,893 | 8/1983 | Johns | 273/239 |
| 4,624,462 | 11/1986 | Itkis | 273/269 |
| 4,732,392 | 3/1988 | Kerr et al. . | |
| 4,838,557 | 6/1989 | Floyhar . | |
| 4,856,787 | 8/1989 | Itkis | 273/237 |
| 4,863,173 | 9/1989 | Chen . | |
| 4,927,748 | 5/1990 | Kinberg | 434/410 |
| 4,988,301 | 1/1991 | Kinberg | 434/410 |
| 5,057,363 | 10/1991 | Nakanishi | 434/409 |
| 5,112,229 | 5/1992 | Gilano et al. | 434/409 |
| 5,230,514 | 7/1993 | Frain | 273/269 |

FOREIGN PATENT DOCUMENTS

| | | | |
|---|---|---|---|
| 2453659 | 12/1980 | France | 273/237 |
| 2034640 | 6/1980 | United Kingdom | 434/409 |
| 2180460 | 4/1987 | United Kingdom | 273/237 |
| 2245868 | 1/1992 | United Kingdom | 434/309 |

*Primary Examiner*—Jessica J. Harrison
*Attorney, Agent, or Firm*—Quirk & Tratos

[57] ABSTRACT

A transparent bingo card overlays a magnetic indicator board. The bingo numbers on the card are marked with a magnetic wand that darkens the area of the magnetic indicator board immediately underneath the bingo number. All marks are erased at the start of new bingo game by an eraser magnet sliding inside of the indicator board. The indicator board incorporates a microprocessor that optically tracks all cards being played by reading data marks on the transparent bingo board.

20 Claims, 23 Drawing Sheets

LAST BALL B4

Fig. 17

LETTER X

Fig. 18

PAY $1.50

Fig. 19

MAGNETIC BINGO BOARD

This invention is a continuation-in-part of the application Ser. No. 07/992,651, filed Dec. 18, 1992, entitled TRANSPARENT BINGO CARD AND INDICATOR BOARD now abandoned.

BACKGROUND OF THE INVENTION

1. Field of the Invention

Similarly to the above pending application, this invention pertains to game boards for playing games of skill and chance, such as bingo, keno, and lottery. In particular, this invention pertains to bingo boards which facilitate manual marking of bingo cards. However, unlike the above pending application, the present invention concentrates on nonelectronic methods that facilitate manual marking of bingo cards.

2. Description of the Prior Art

Reusable bingo cards/boards (often called hard bingo boards), such as disclosed in U.S. Pat. Nos. 4,165,878, 4,084,823, 3,984,107, 3,909,001, and 3,731,935 are widely used in bingo halls because they are relatively inexpensive and durable. However, hard bingo boards can not be as easily marked as the paper bingo cards. The usual method of marking a hard bingo card involves either placement of a manual marker (such as a color plastic chip) on top of each called bingo number that is imprinted on the hard bingo board, or shutting/opening of a sliding window in the hard bingo board. Placing markers and/or opening and closing the windows slows down the game compared to daubing paper bingo cards with by a dauber. In addition, the hard bingo boards are relatively insecure because they can be easily replaced in the middle of the game by a dishonest player.

Numerous attempts have been made to improve hard bingo boards. For example, U.S. Pat. Nos. 4,455,025, and 4,624,462 disclose an electronic bingo indicator board overlaid by a transparent hard bingo board. However, electronics makes this type of board more complex and costly than nonelectronic/mechanical hard bingo boards. Nevertheless, utilization of electronics provides an opportunity to increase accountability of transparent hard bingo boards by utilization of various data card reading techniques as disclosed in U.S. Pat. Nos. 4,455,025, 4,624,462, 4,372,392 and 4,863,173.

SUMMARY OF THE INVENTION

The present invention overcomes stated deficiencies of both electronic and mechanical hard bingo boards by utilization of the technique of magnetic imaging that was developed outside of the field of games of chance and skill. The magnetic imaging technique is disclosed in a number of U.S. patents including the U.S. Pat. Nos. 5,112,229, 5,057,363 and 4,143,472 and is based on utilization of an array of two-chamber cells containing magnetic particles. A magnetic marker/'pencil' allows one to 'draw' on the top surface of a 'display' formed by a plurality of such cells, and a magnetic 'eraser' attached to the back side of such a 'display' allows one to 'erase' the temporary drawing.

Accordingly, it is the prime objective of the present invention to develop a simple nonelectronic bingo indicator board facilitating manual marking (daubing) of called bingo numbers exhibited on the bingo board and to provide a simple way for erasing all marked bingo numbers at the end of the game.

Another objective of the present invention is to provide the capability to play a variety of bingo cards having various informational content with the help of the same indicator bingo board.

Still another objective of the present invention is to provide for easy upgrading of the indicator board by attaching an electronic adapter to the basic indicator board, adding to the basic indicator board the capabilities of automatic accounting for the played bingo cards as well as providing a player tracking capability. It is also an objective of the present invention to centralize the functions of card accounting and player tracking by interconnecting the upgraded indicator boards with a central computer.

These and other objectives of the present invention will become more apparent from the following drawings and from the description of the preferred embodiment.

BRIEF DESCRIPTION OF THE DRAWINGS

FIG. 17 shows the first message on the display.

FIG. 18 shows the second message on the display.

FIG. 19 shows the third message on the display.

DESCRIPTION OF THE PREFERRED EMBODIMENT

Figure 1:
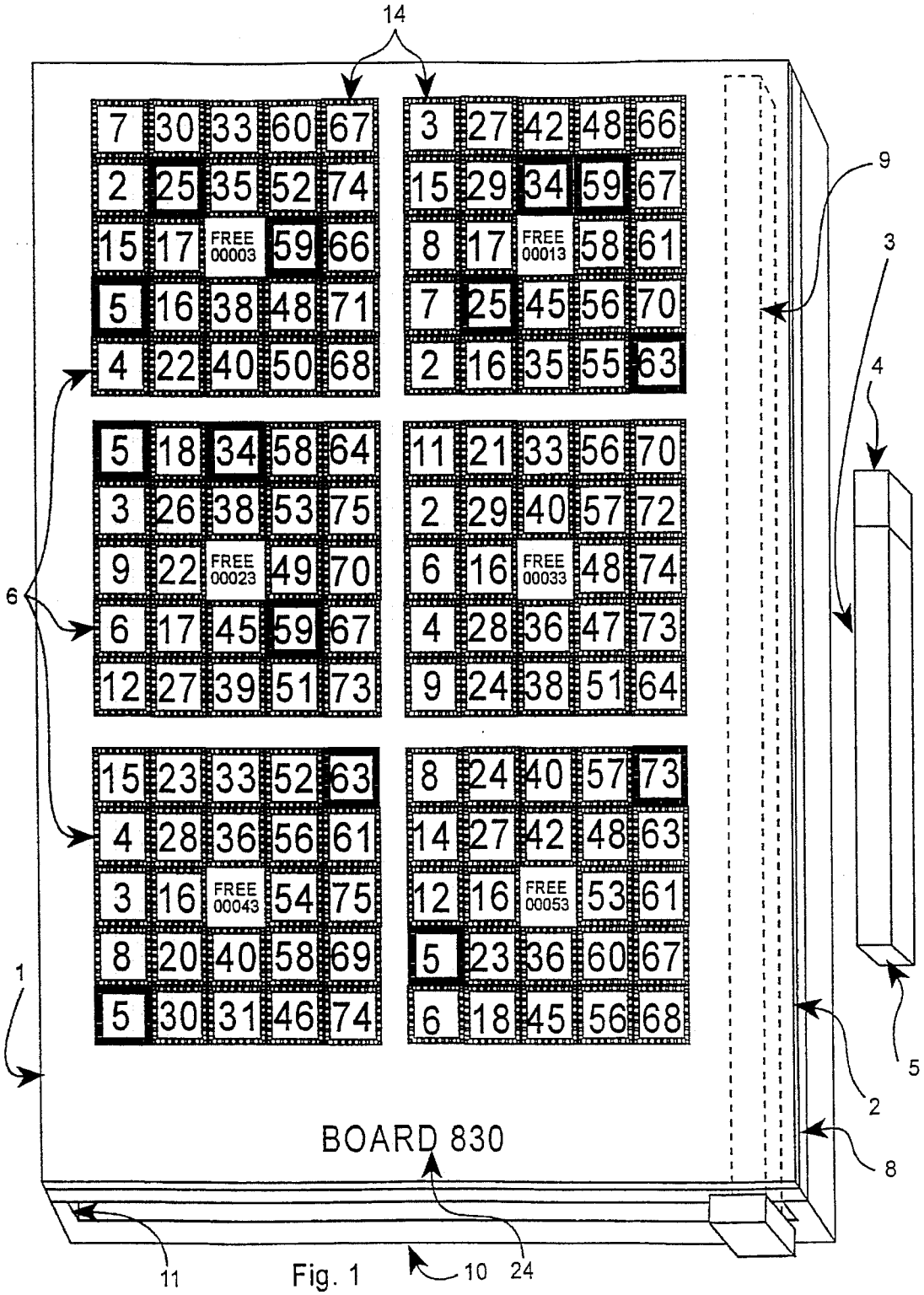
FIG. 1 shows the basic magnetic bingo board.

The preferred basic configuration of the magnetic bingo board is exhibited in FIG. 1, wherein 1 is a magnetic indicator board, 2 is a transparent bingo board overlaying the magnetic indicator board 1, and 3 is a magnetic marker housing a marker magnet 4 on its handle 5. The transparent bingo board 2 is made of a relatively thin transparent mylar sheet that carries six imprinted bingo cards 6 on its surface.

Figure 2:
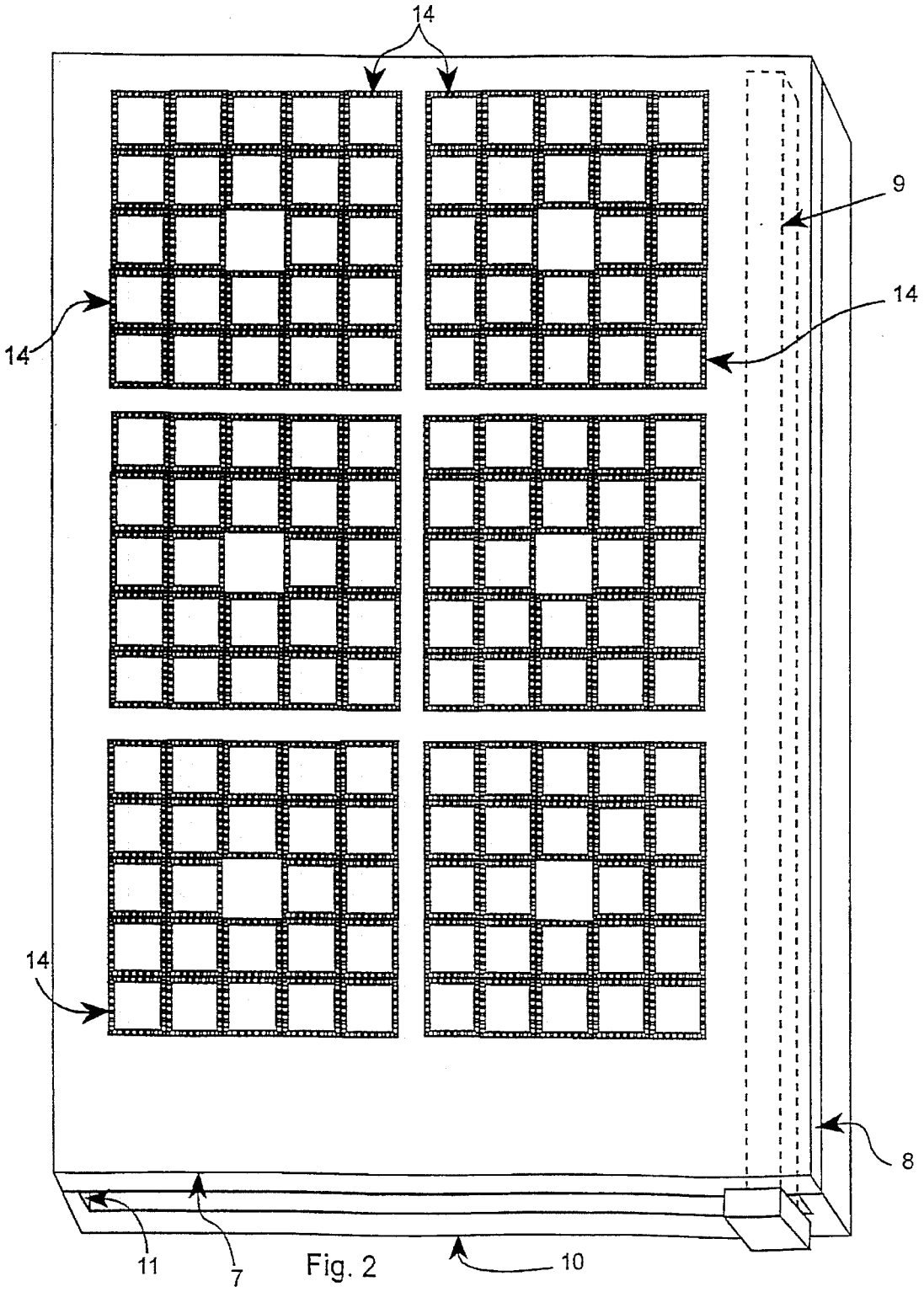
FIG. 2 shows the basic magnetic indicator board.

The magnetic indicator board 1 (shown separately, without the transparent bingo board 2 in FIG. 2) is manufactured as an essentially flat rectangular box 7. The top surface of the box 7 is formed by a rectangular magnetic indicator panel 8. An eraser magnet 9 is enclosed between the top indicator panel 8 and the bottom pan 10 of the box 7. The eraser magnet 9 is attached to the handle and can slide through the entire slot 11 formed between the indicator panel 8 and the bottom pan 10.

Figure 3:
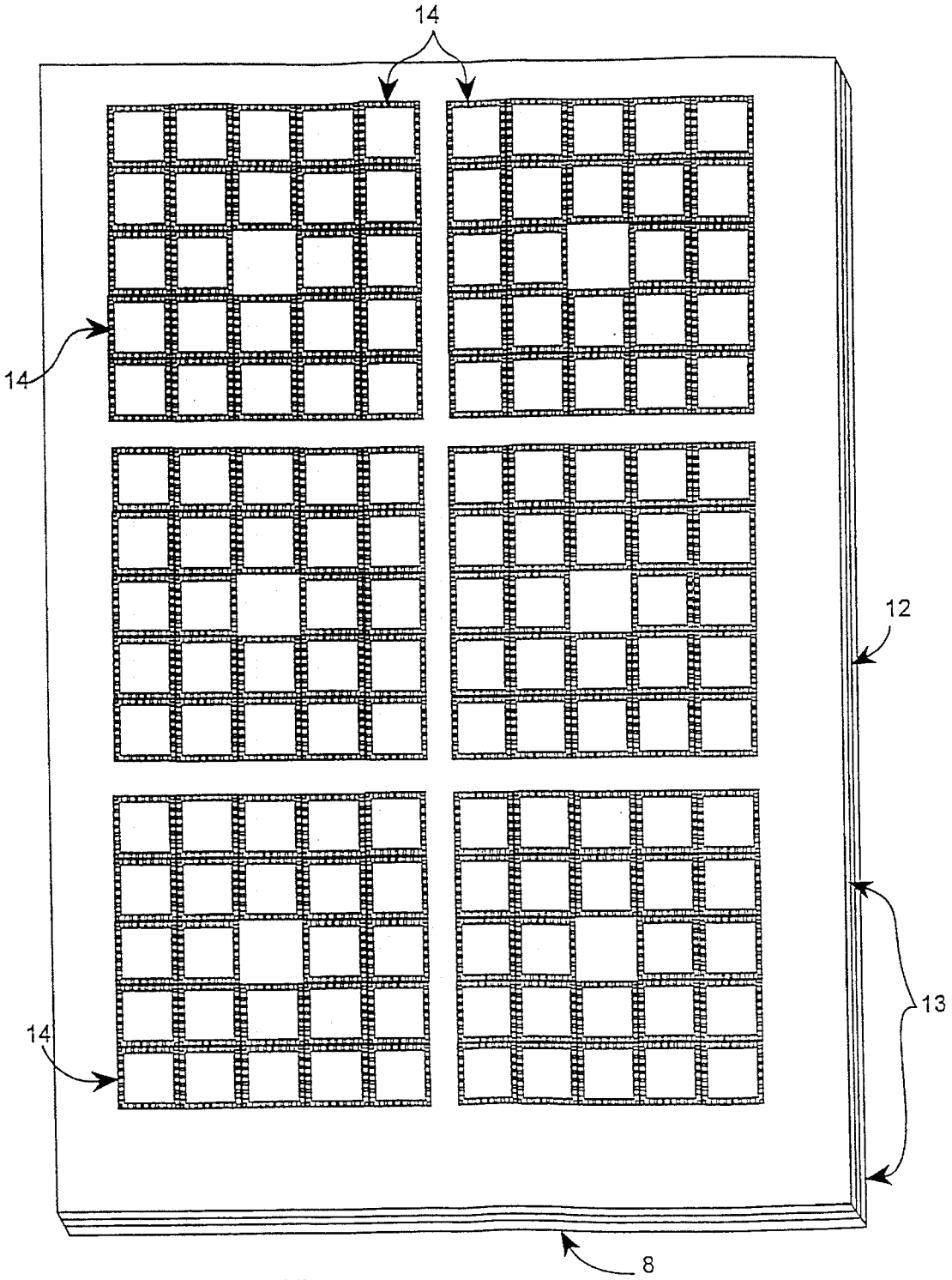
FIG. 3 shows magnetic indicator panel.

The rectangular magnetic indicator panel 8 (shown separately in FIG. 3) is formed by an essentially white plastic substrate 12 that is sandwiched between two transparent mylar sheets 13. The magnetic indicator panel 8 is the carrier of 144 magnetic cellular indicator frames 14 shown in FIG. 3. The magnetic cellular indicator frames are arranged in 6 groups of 24 individual magnetic indicator frames aligned as 5-by-5 square matrices.

Figure 4:
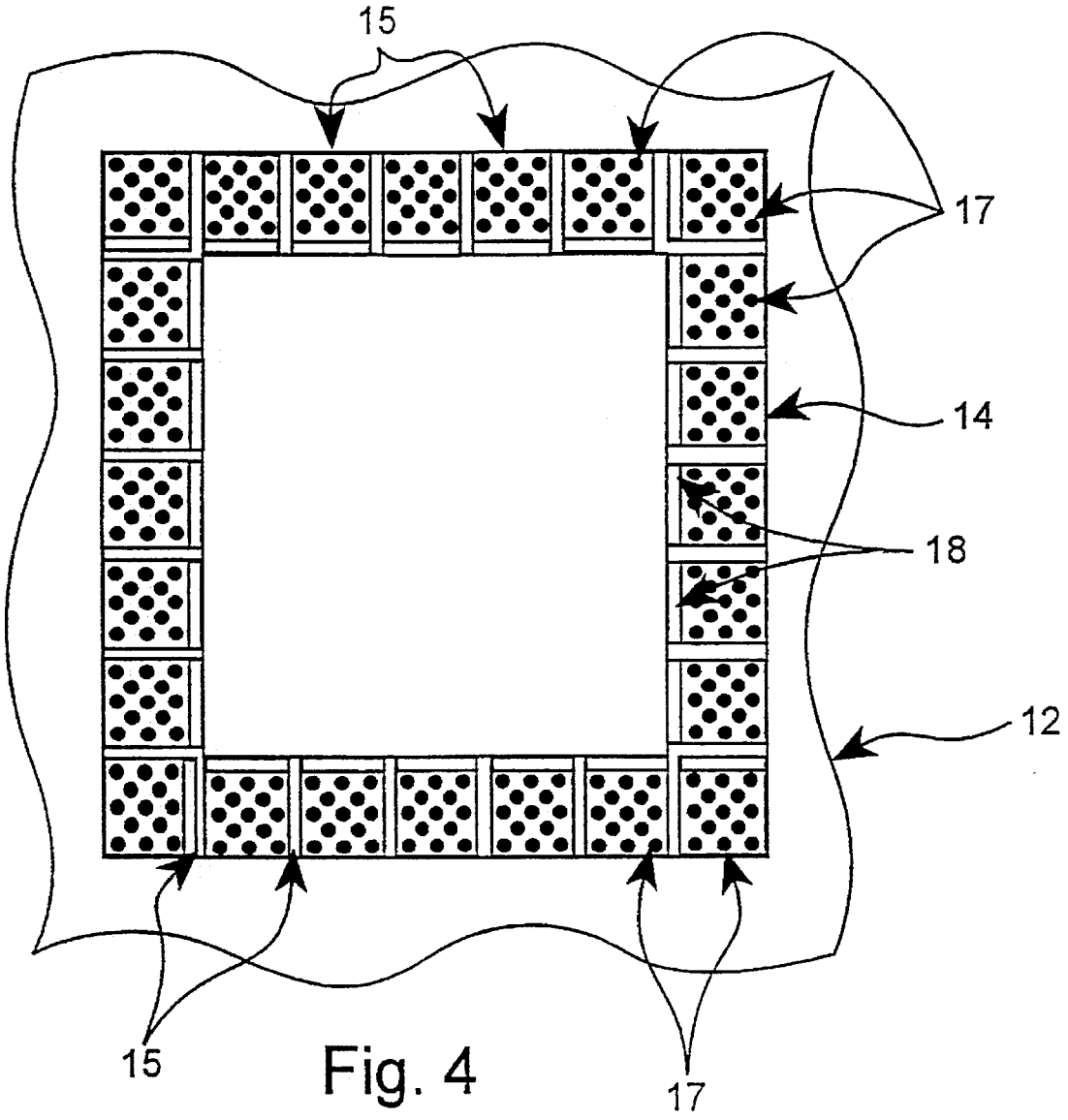
FIG. 4 shows a single magnetic cell.
Figure 5:
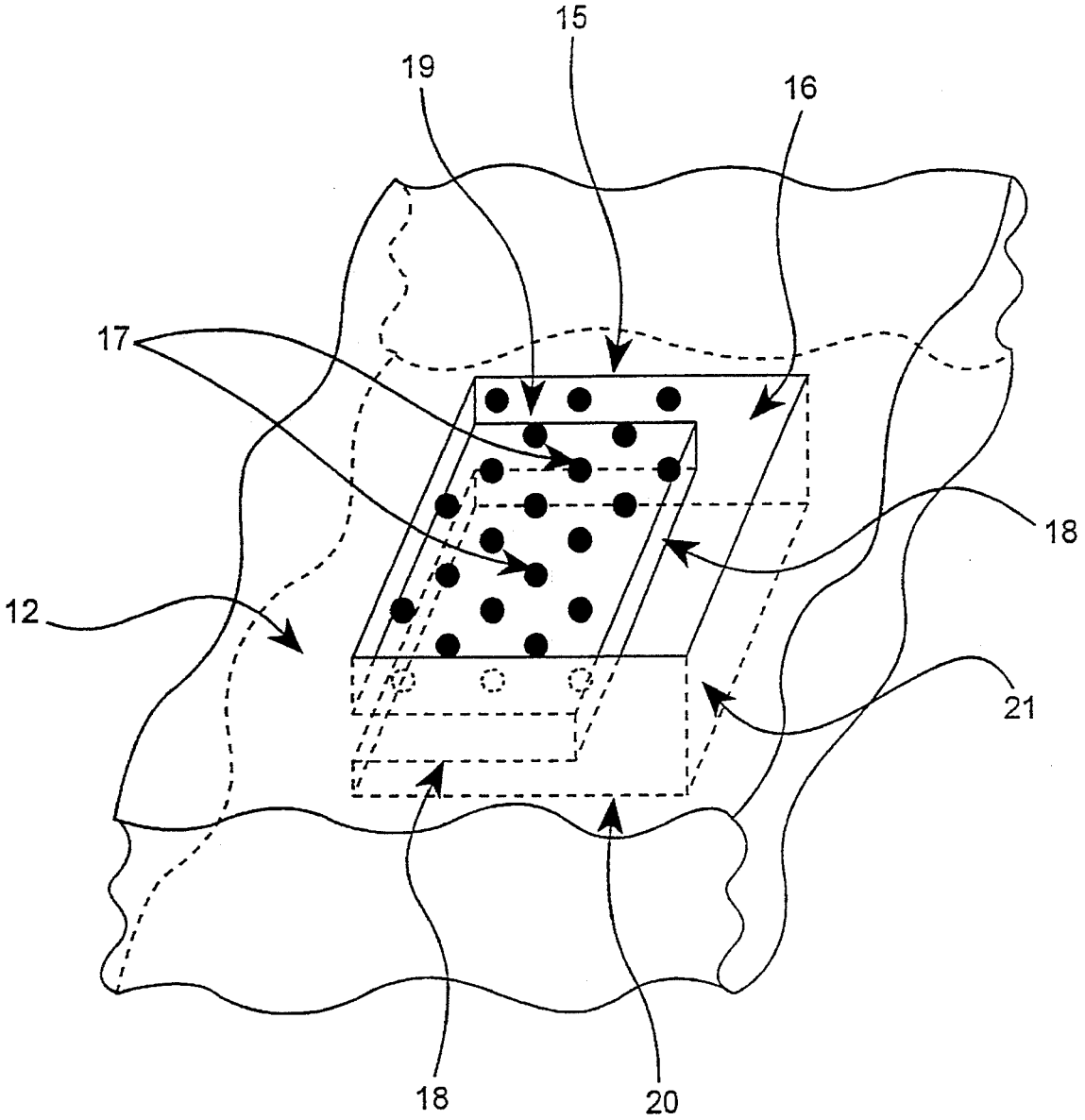
FIG. 5 shows the vertical cross section of the magnetic cell in the non-transparent state.

The composition of an individual magnetic indicator frame 14 is shown in FIG. 4, wherein 15 are individual magnetic indicator cells. An individual magnetic indicator cell 15 is shown in FIG. 5 as a cavity 16 formed in the nontransparent substrate 12 of the magnetic indicator panel 8, wherein 17 are magnetic particles, 18 is a divider shelf formed in the substrate 12, 19 is the front (top) chamber, 20 is the back (bottom) chamber, and 21 is the channel interconnecting the front and the back chambers. The magnetic particles 17 are shown in FIG. 5 as resting on the top surface of the shelf 18.

Figure 6:
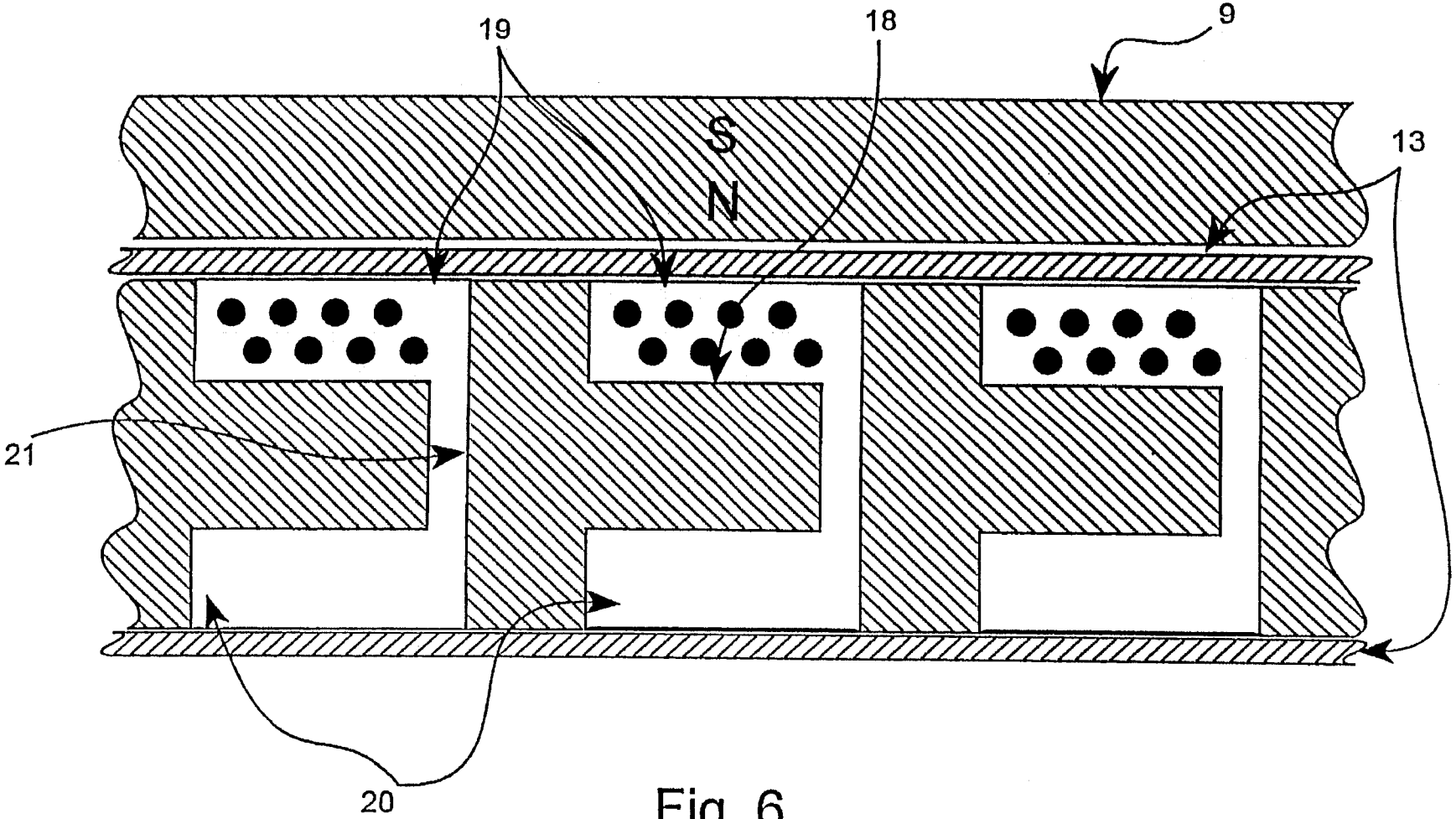
FIG. 6 shows the vertical cross-section of the magnetic cell in the transparent state.

To bring the magnetic particles 17 into the position on top of the shelf 18, a marker magnet 4 has to be positioned above the magnetic cell 15 as is shown in FIG. 6. More specifically, a partial vertical cross section of three neighbor magnetic cells 15 (belonging to a particular magnetic indicator frame 14) is shown in this figure (FIG. 6), wherein 4 is a magnet, 13 is the top transparent mylar sheet covering all magnetic cells 15 (this sheet is securely attached to the top of the substrate 12). The bottom transparent mylar sheet 13 is securely attached to the bottom of the substrate 12, so that in combination, the top and the bottom mylar sheets 13 hermetically encapsulate the substrate 12. The shelf 18 retains magnetic particles 17 even after the marker magnet 4 is removed from the top of the magnetic cells 15 as is shown in FIG. 5. Viewed from above, then the magnetic cell 15 appears to be black (assuming the magnetic particles 17 are sufficiently small and not artificially colored). Similarly, if a marker magnet 4 on the tip of marker 5, is temporarily placed on top of the entire magnetic indicator frame 14, and subsequently is removed, then the entire magnetic indicator frame 14 will appear to be black as shown on FIG. 4.

Figure 7:
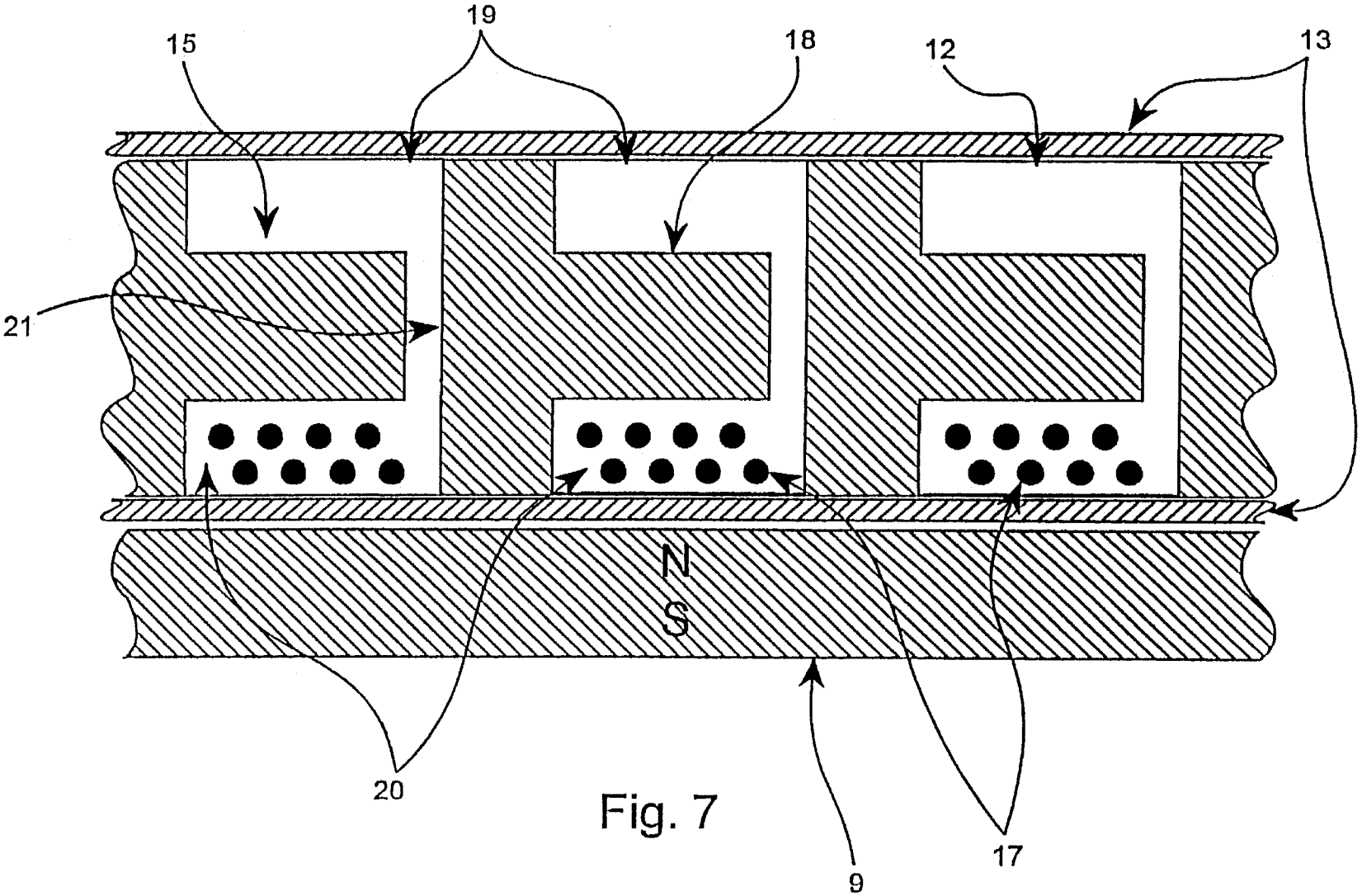
FIG. 7 shows the image of a black frame formed by a frame-shaped array of magnetic cells in the non-transparent state.
Figure 8:
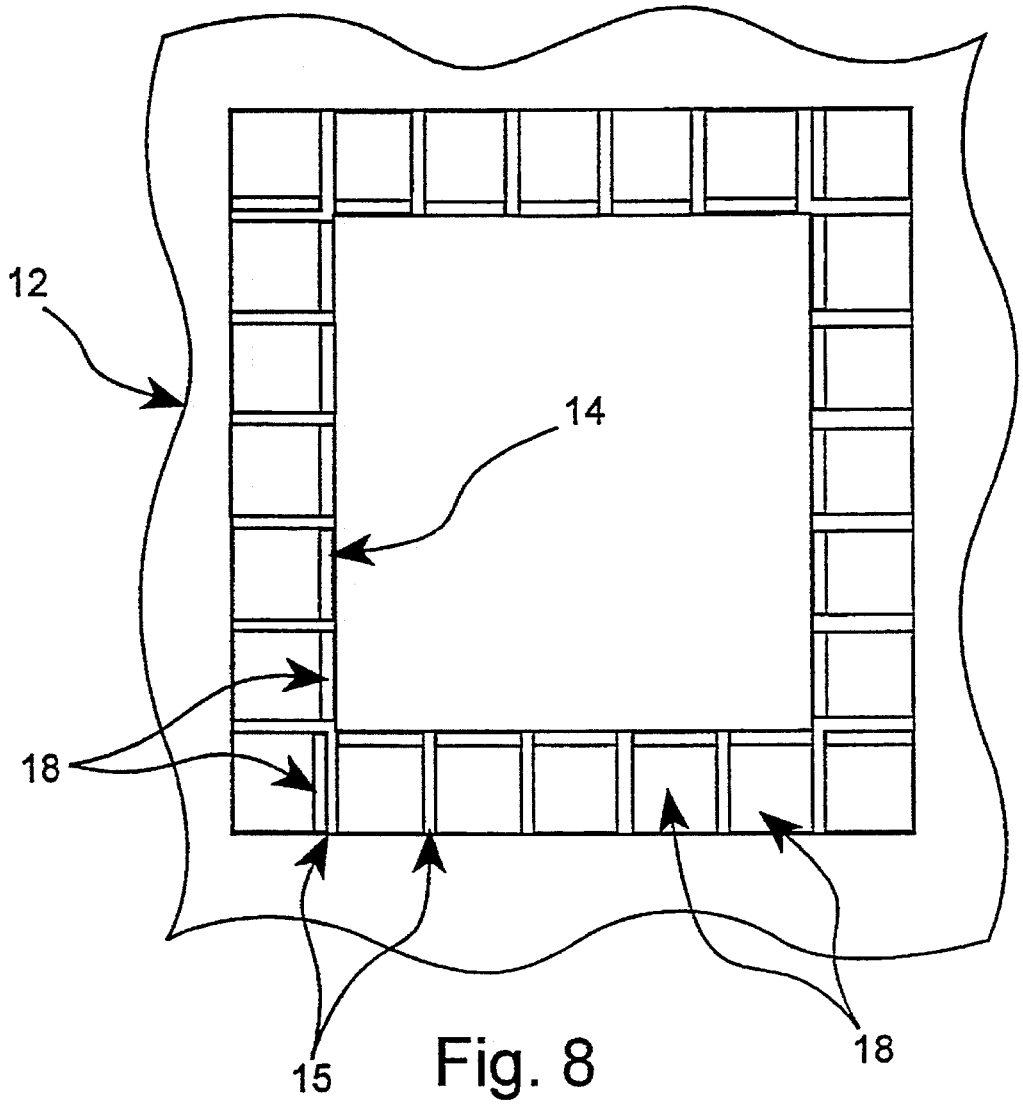
FIG. 8 shows the image of a black frame formed by a frame-shaped array of magnetic cells in the transparent state.

On the contrary, if a magnet 9 is positioned below the magnetic cells 15 as is shown in FIG. 7 then the magnetic particles 17 migrate from the top of the shelf 18 via channel 21 underneath the shelf 18, into the bottom chamber 20. The magnetic particles 17 positioned under the white nontransparent shelves 18 are hidden from view above the magnetic cell 15 and the cell 15 appears to be blank as is shown in FIG. 8, wherein the entire magnetic indicator frame 14 is blank because all magnetic particles 17 in all magnetic cells 15 forming the frame 14 are positioned under their respective blank shelves 18. The eraser magnet 9 allows a simple way to blank (erase) all magnetic indicator frames 14 (with all their constituent magnetic cells 15) of the entire magnetic indicator board 1. It is sufficient to pass the eraser magnet 9 through the length of the slot 11 underneath the indicator panel 8 to clear the entire magnetic indicator panel 8.

To play bingo on bingo cards 6 that are imprinted on the transparent bingo board 2 , the player utilizes the magnetic marker 5 and the magnetic indicator board 1. First, the player clears all magnetic cells 15 of the magnetic indicator board 1 by sliding the eraser magnet 9 through the entire length of the slot 11. Second, the player places the transparent bingo board 2 on top of the magnetic indicator board 1 and aligns the edges of the transparent bingo board 2 with the edges of the magnetic indicator board 1 (slides may be easily attached to the magnetic indicator board 1 to facilitate the alignment process). Third, as bingo numbers are called by the bingo caller, the player touches the called numbers on bingo cards 6 with the tip 4 of the magnetic marker 5. Such touching of the numbers on the bingo cards 6 with the marker 5 causes the magnetic indicator frames 14 underneath the respective touched numbers to blacken as described above. For example, if bingo numbers 5, 25, 34, and 59 are called by the bingo caller, the player then touches (with the marker 5) these called numbers on the bingo cards 6, and as shown in FIG. 1 these bingo numbers on the bingo cards 6 appear to become surrounded by black rectangular frames, achieving the effect of marking the called numbers on the bingo cards being played by the player. At the end of the bingo game, the player slides the eraser magnet 9 through the slot 11 again to clear all bingo cards 6 in preparation for the next bingo game.

Figure 10:
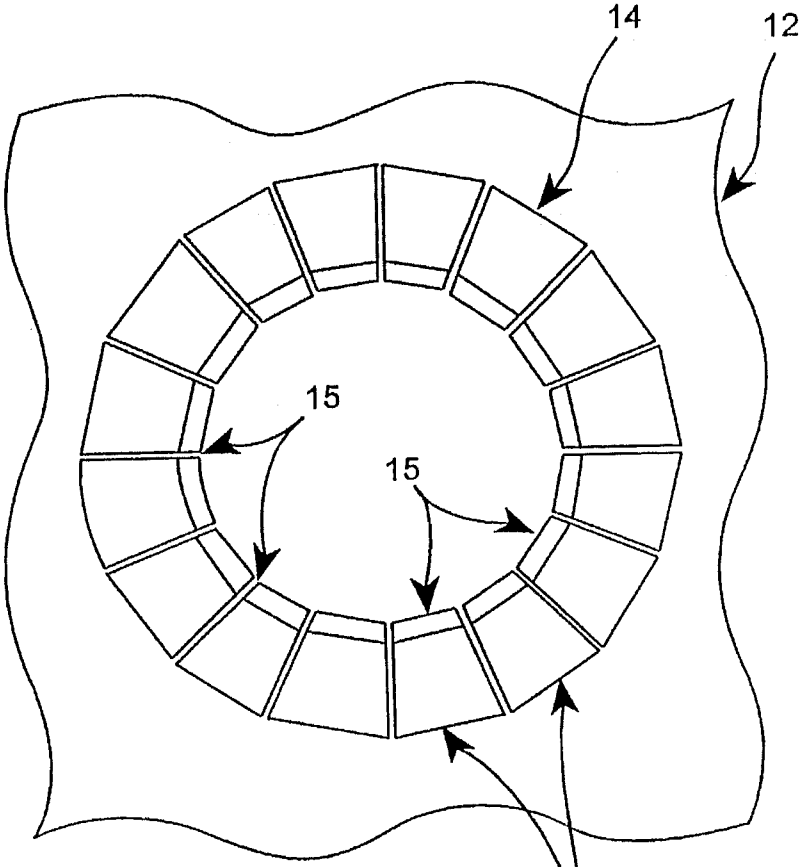
FIG. 10 shows the image of a black circle formed by a circle-shaped array of magnetic cells in the transparent state.
Figure 9:
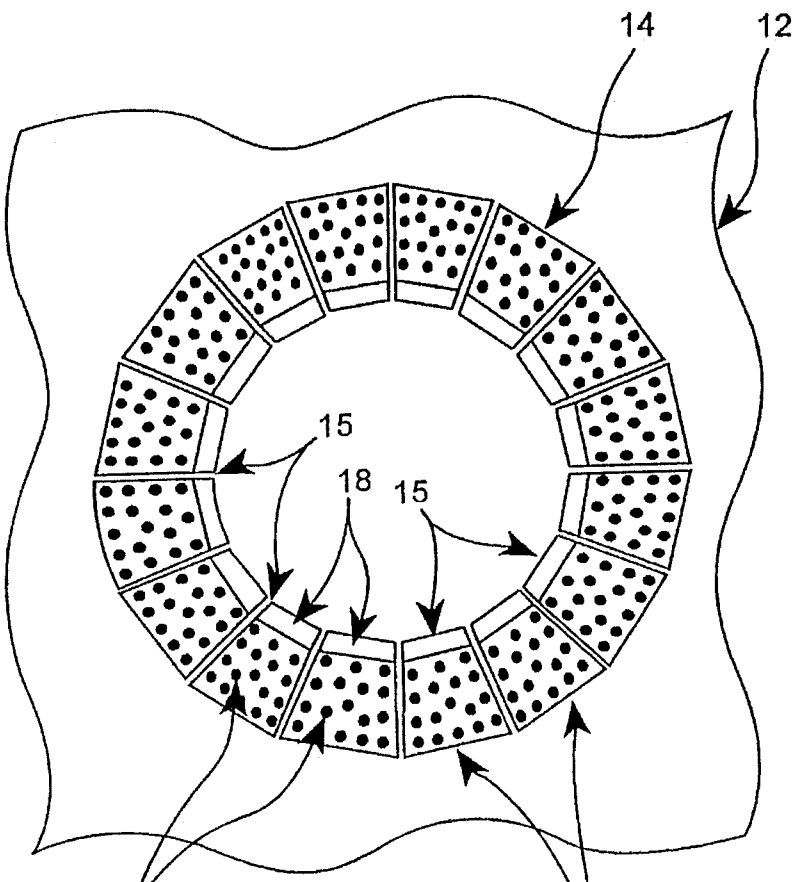
FIG. 9 shows the image of a black circle formed by a circle-shaped array of magnetic cells in the non-transparent state.
Figure 11:
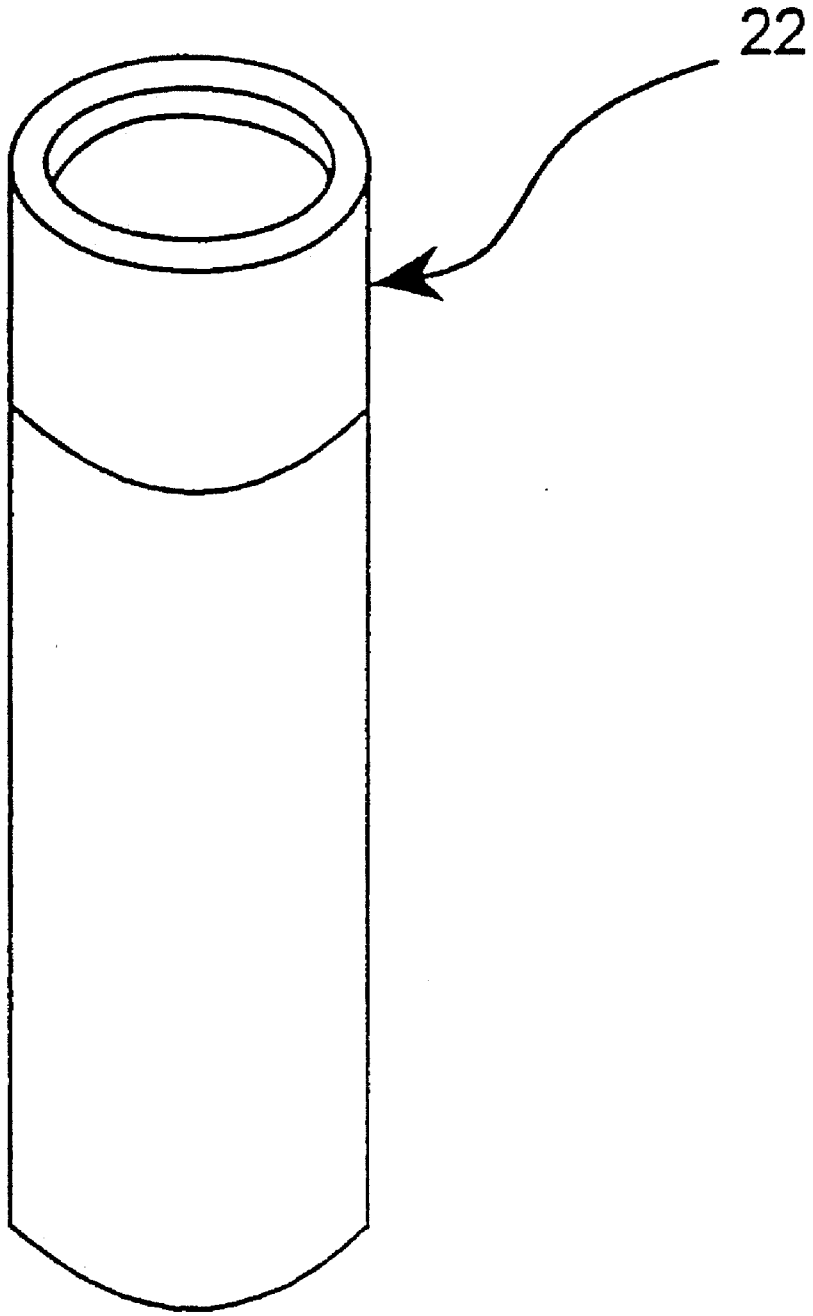
FIG. 11 shows a cylindrical magnetic marker.

While a specific embodiment of the invention has been shown and described in detail to illustrate the application of the invention principles, the invention may be implemented in another manner without departing from such principles. For example, neither the magnetic cells 15 nor the magnetic indicator frames have to be rectangular. FIGS. 9 and 10 show essentially circular magnetic indicator frames 14 formed by essentially trapezoidal magnetic cells 15. In particular, FIG. 9 shows the magnetic indicator frame 14 with the magnetic particles 17 residing on top of respective substrate shelves, whereas FIG. 10 shows the same cells with the magnetic particles 17 hidden under the shelves creating an appearance of a blank indicator frame 14. To match the circular indicator frames 14, the magnetic marker has to have a ring-shaped magnet 22 at its tip as shown in FIG. 11. In general, both magnetic indicator frames 14 and magnetic cells 15 can be of an arbitrary shape and vary in quantity. Ultimately, the entire magnetic indicator panel 8 may be densely populated by a contiguous array of magnetic cells, e.g. of hexagonal shape as disclosed in U.S. Pat. No. 4,143,472.

Although the magnetic particles 17 were described above as having natural black color, they may be easily colorized by adding various color additives. For example, red colorization of magnetic particles 17 may help the player to easily recognize marked numbers on bingo cards 6. Moreover, the magnetic particles may be manufactured in such a way that their opposing ends are of different color. In the latter case, the magnetic wand 5 may be equipped with an additional eraser magnet at its opposite end, and then the player will be able to selectively mark and unmark a bingo number on the transparent bingo board 2.

The transparent bingo board 23 carries a unique identification number 24 imprinted on its surface. This identification number signifies the independence of the transparent bingo board 23 from the magnetic indicator board 1. However, the transparent bingo board 23 may be permanently, securely, attached to the magnetic indicator board 1. In fact, it may serve in lieu of the top mylar sheet 13 as a cover for all magnetic cells 15.

Figure 12:
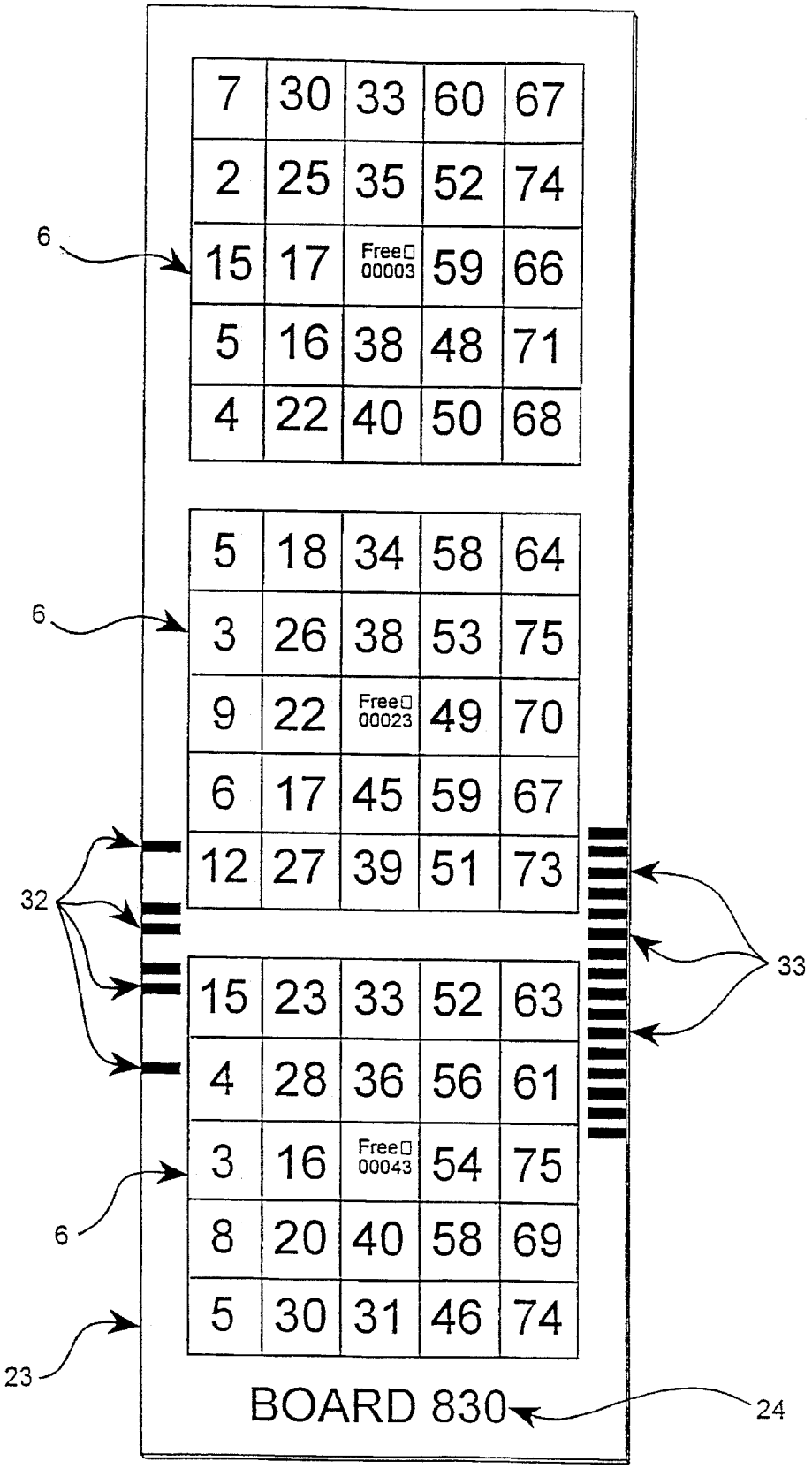
FIG. 12 shows a transparent bingo card.

The transparent indicator board 1 is not restricted to having exactly six bingo cards imprinted on its surface. The number of bingo cards may vary widely. For example, FIG. 12 shows a three-card transparent bingo board 23. This transparent bingo board is specifically designed to be used in conjunction with an upgraded magnetic indicator board 1 shown in FIG. 13, wherein 24 are two separate sections of the magnetic indicator panel 8, 25 are alignment slides, 26 are optical readers, 27 is a Liquid Crystal Display (LCD), 28 is an identification key reader, 29 is a Local Area Network (LAN) connector, 30 is a membrane keypad, and 31 is a radio antenna.

The three-card transparent bingo board carries its unique identification number in both human readable format 24 and machine readable format. The machine readable format is composed of the data markings 32 on its left side and by the clock markings 33 on its right side. When this board is inserted on top of a section of a magnetic indicator panel 8 through the slides 25, the optical reader 26 on the right side of the respective strip reads in clock markings 33 encoded on the right side of the transparent bingo board 23, and the optical reader on the left side of the respective slide reads in data encoded in the data markings 32 ((the optical reader 26 includes a matched pair consisting of a Light Emitting Diode (LED) coupled with a Photodetector Diode that may be arranged as either a reflective pair or a see-through pair)).

Figure 14:
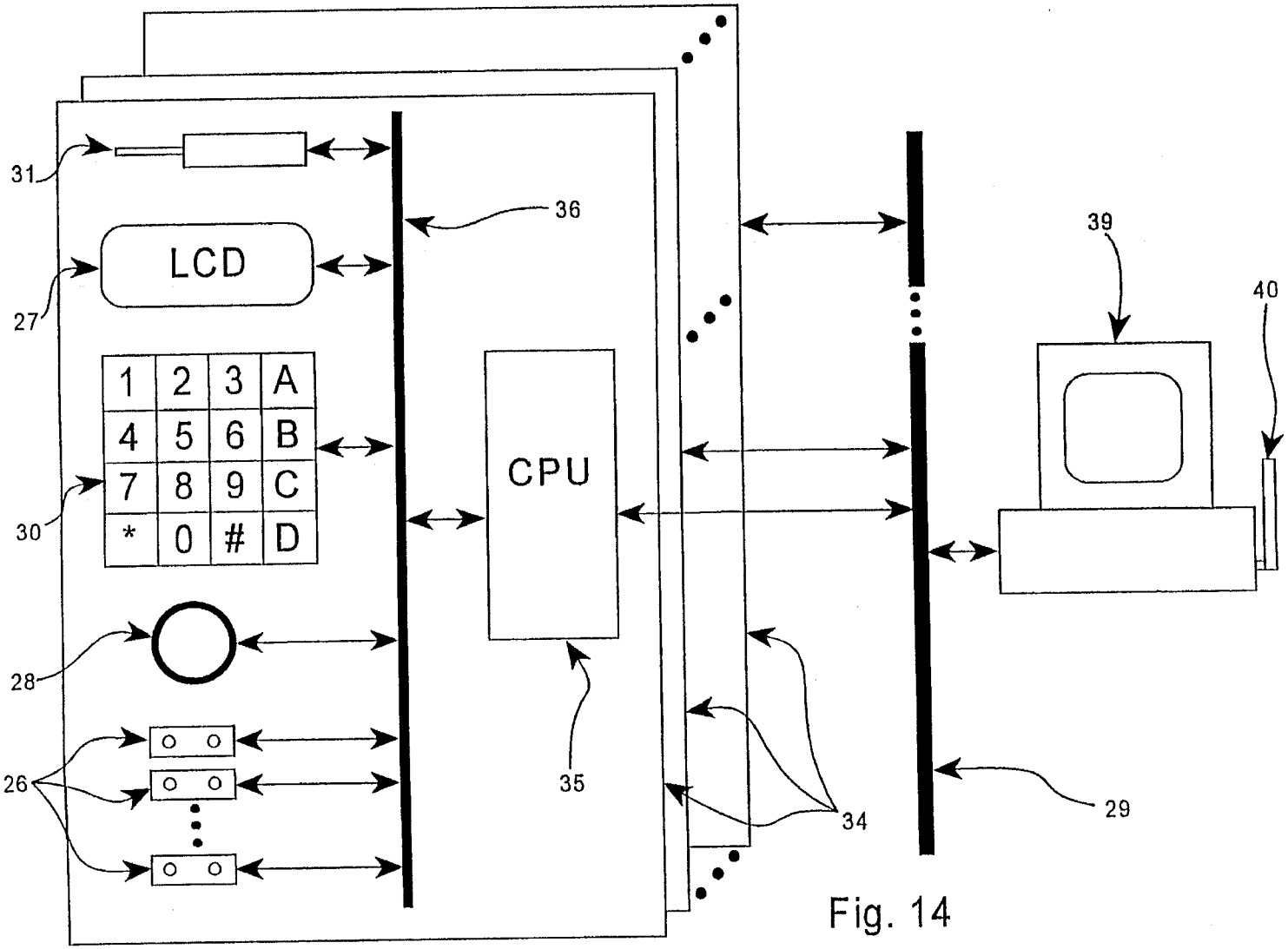
FIG. 14 shows the block diagram of the upgraded bingo indicator board.

The signals developed by the optical readers 26 are processed by a microprocessor 34 that is embedded in the body of the upgraded magnetic indicator board 1. The block diagram of the microprocessor 34 is shown in FIG. 14, wherein 35 is the Central Processor Unit (CPU), 27 is a LCD, 30 is a membrane keypad, 28 is an identification key reader, 26 are optical readers, 36 is an internal bus of the microprocessor, 37 is radio transmitter receiver, 38 is a LAN interface, 29 is LAN that interconnects the microprocessor 34 with the central computer 39 (and with pier microprocessors 34 embedded in magnetic indicator boards 1 operated by other players).

Figure 13:
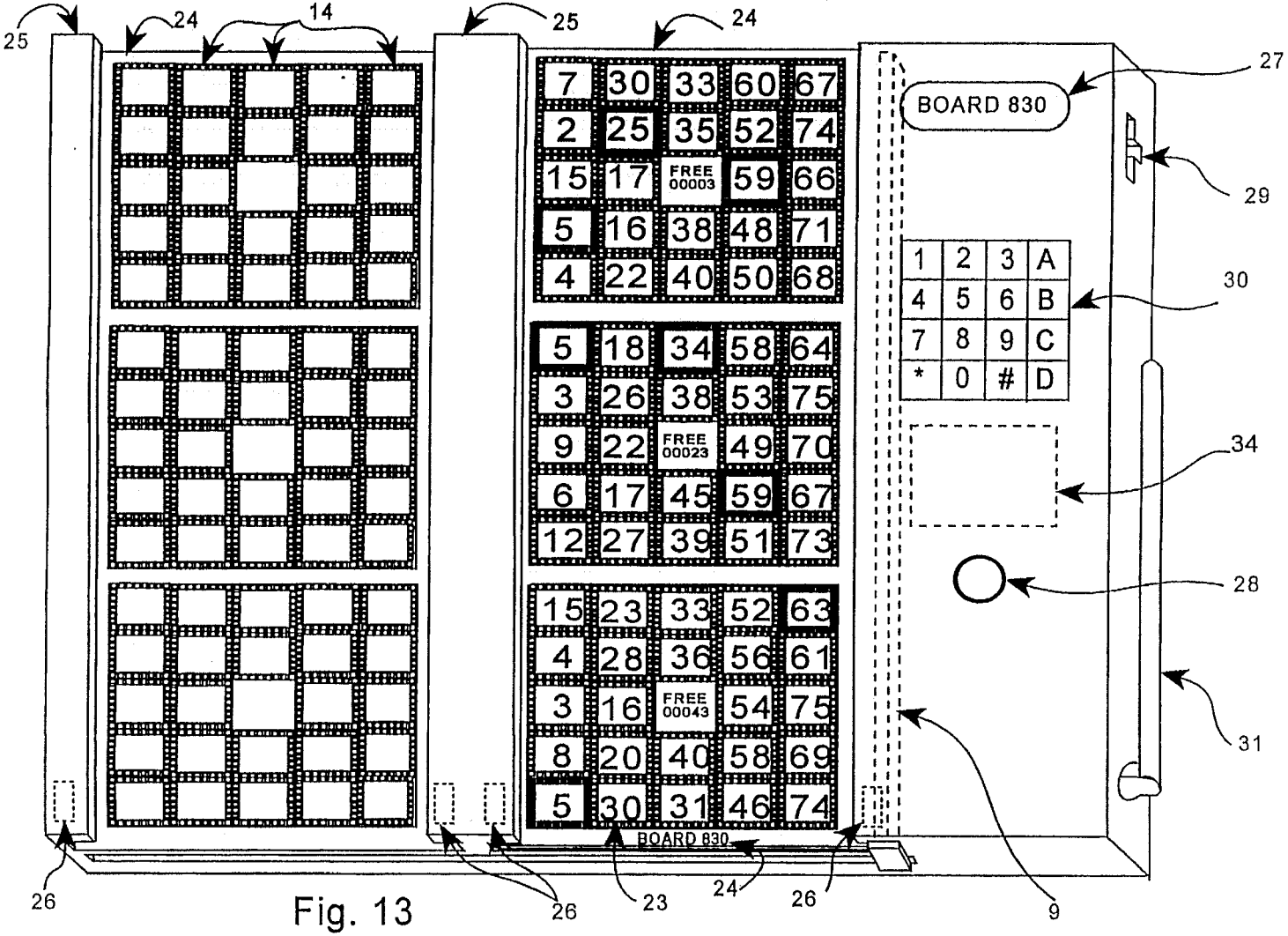
FIG. 13 shows an upgraded bingo indicator board.

Once the microprocessor 34 reads in and verifies the identification number 24 of the transparent bingo board 23, it displays this identification number on the LCD 27 as shown in FIG. 13. In addition the microprocessor 34 sends the identification number 24 to the central computer 39 via LAN 29. Alternatively, the microprocessor 34 may send this data to the central computer 39 via the radio transmitter-receiver 37, and the central computer 39 receives the identification number 24 via its embedded receiver-transmitter indicated in FIG. 14 by the antenna 40. The central computer 39 logs (and processes) all identification numbers 24 of all transparent bingo boards 23 played by all players in the bingo hall that utilize magnetic indicator boards 1. By doing so, the central computer 39 provides accountability for all transparent bingo boards 23 played by all players in the bingo hall. Also, the registration of all transparent bingo boards 23 being played is critical for verification of the winning bingo cards. For example, if a player claims a bingo on one of his/her bingo cards imprinted on the transparent bingo board 23, and this specific transparent bingo board 23 is not registered with the central computer 39, then such a claim should be declared invalid.

Figure 15:
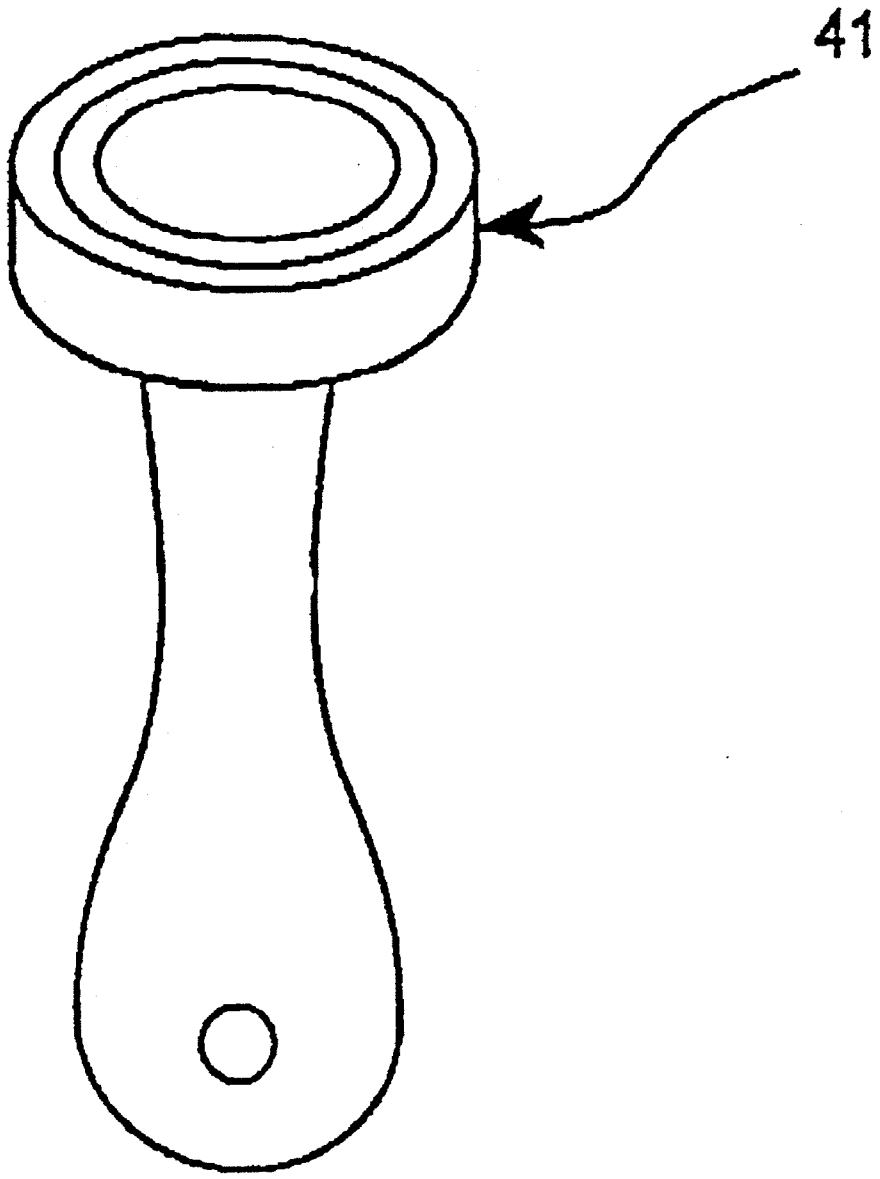
FIG. 15 shows the player identification key.

In addition to providing accountability for the identity of the transparent bingo boards 23, the central computer 39 also accounts for the identity of the players using these boards. Specifically, a player using a magnetic indicator board 1 identifies himself/herself to the magnetic indicator board 1 by briefly touching the identification key reader 28 with his personal identification key 41 (shown in FIG. 15) that houses at its tip a nonvolatile identification chip, such as the DS199X chip manufactured by Dallas Semiconductor. The key reader 28 reads in the player identification encoded in the identification key 41 and passes it to the microprocessor 34, which in turn relays this player identification to the central computer 39 via the LAN 29 or through the radio communication channel formed by receiver-transmitters 37 and 40. By granting to the players award points for participation in the game, the players are encouraged to use their identification keys 41. The central computer 39 tracks all players and all bingo cards 6 played by those players.

Figure 16:
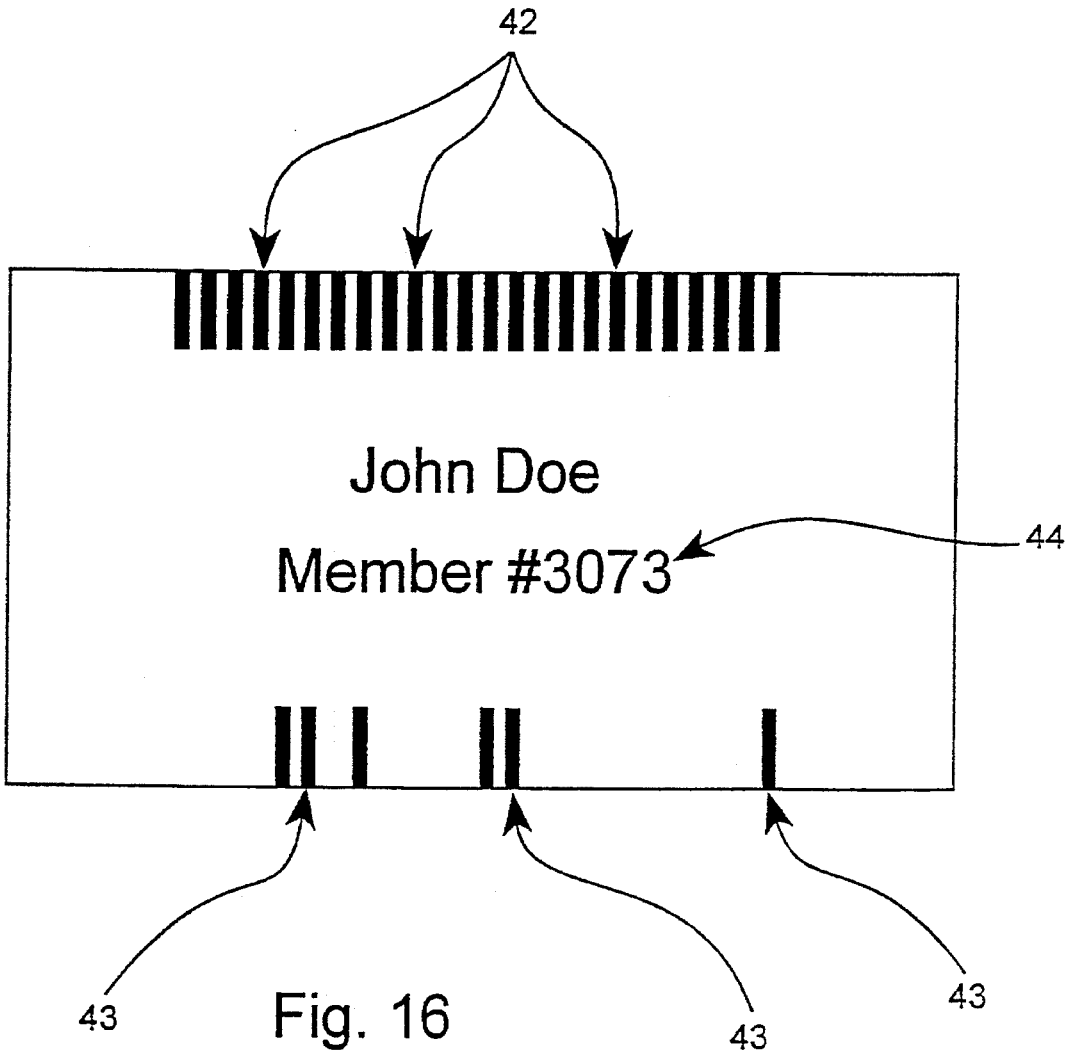
FIG. 16 shows the player club card.

As an alternative, the player tracking may be achieved using optical readers rather then the identification key reader 28. Specifically, a player may be provided with a player club card as shown in FIG. 16. The player club card shown in FIG. 16 carries the player identification number in both machine readable format (as a combination of the clock markings 42 and the data markings 43) and in regular imprinted form 44. The magnetic indicator board 1 may be equipped with an additional pair of optical readers 26 dedicated for player club card reading. Alternatively, any of the existing pair of readers 26 may be used for reading the player club card (the player club card identification number 44 can be made readily distinguishable from any transparent bingo card identification number 24, e.g. by the range).

The central computer 39 may not only receive accounting data from magnetic indicator boards 1, but may also send back data to magnetic indicator boards 1 via the LAN 29 or the radio channel (37 and 40). For example, the central computer 39 may send down to the magnetic indicator boards 1 bingo numbers being called, and the magnetic indicator boards 1 may display these called numbers to players on their respective LCD's as is shown in FIG. 17. Similarly, the bingo patterns (such as LETTER X pattern shown in FIG. 18), the card prices, the prizes, and other game relevant data may be send down from the central computer 39 to magnetic indicator boards 1.

The radio channel (37 and 40) and the LAN 29 do not have to necessarily be used together; only one of them may be utilized in a specific instance and even in one direction only, e.g. from central computer 39 down to the magnetic indicator boards 1 only.

Moreover, various type of information may be transmitted via different media channels at different stages of the game. For example, the magnetic indicator boards 1 may not communicate with the central computer 39 while the bingo games go on. The magnetic indicator boards 1 may just accumulate the transparent bingo boards 1 accounting data and the player identification 44 information in real time and only after all games are over may dump the accumulated data into the central computer 39.

Such an arrangement will allow for the option of making magnetic indicator boards 1 battery operated and portable. This stand alone mode of operation of magnetic indicator boards 1 may be facilitated by pre-downloading the magnetic indicator boards 1 with pricing board information before the games begin, and by running accounting computations for the actually used transparent bingo boards 1 internally in the microprocessor 34 with real time displaying of the charge on LCD 27 as shown in FIG. 19. At the end of the day, the portable units may be connected to the central computer 39 for recharging and uploading the accumulated accounting information into the central computer 39. In addition, the bingo attendants (clerks, agents, etc.) may be provided with special supervisory identification keys of the type 41. By touching the identification key reader 28 with such a key 41, the bingo attendant may grant a certain credit to the magnetic indicator board 1, or may verify payment of the current charge that the player owes to the bingo hall. The supervisory identification keys may actually be smart microprocessors that are pre-downloaded from the central computer 39 with encoded pricing information and encoded sequences of authorization transaction identification numbers.

Figure 20:
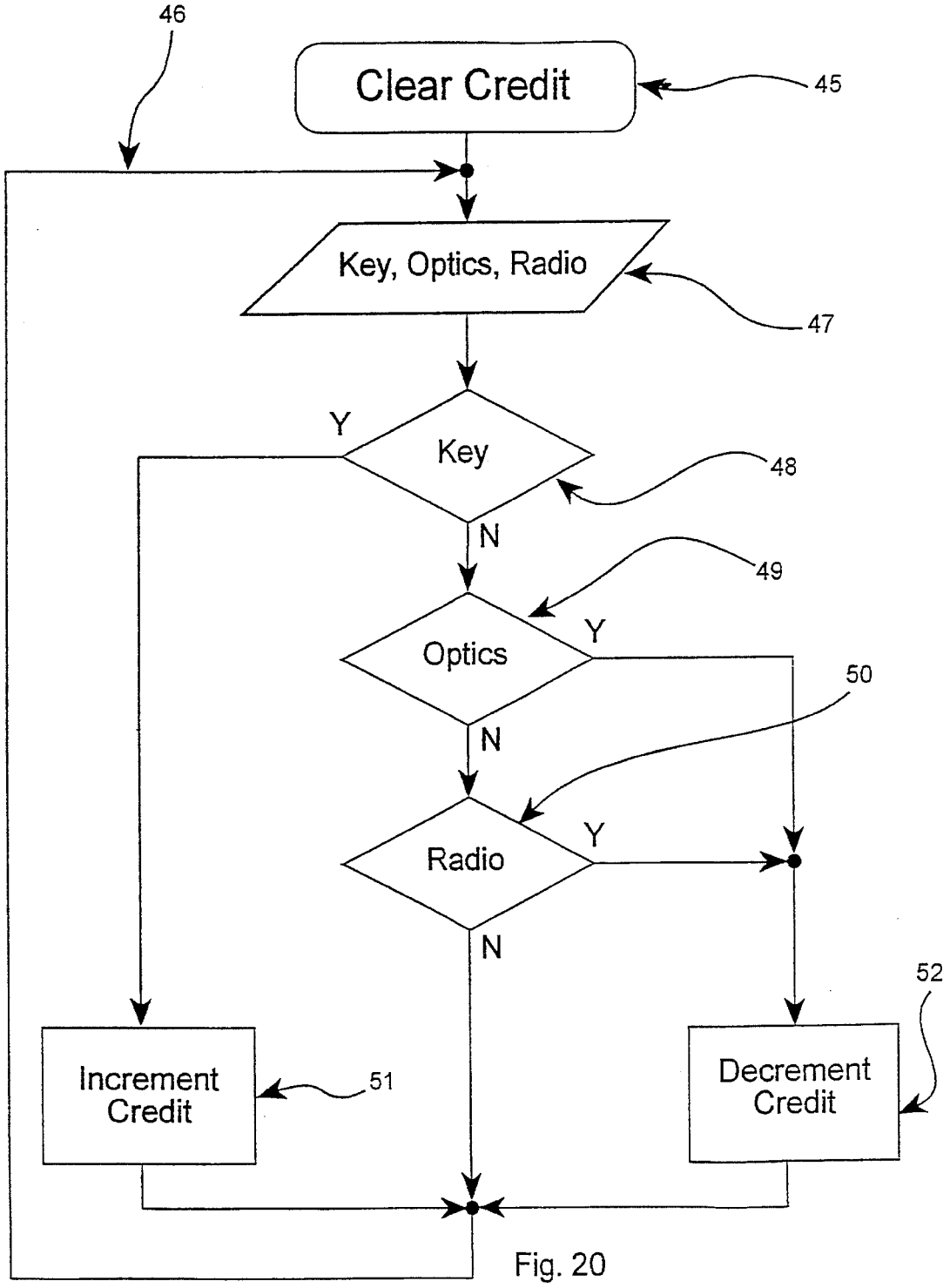
FIG. 20 shows the flow chart of the credit balance subroutine.

FIG. 20 shows a simplified flow chart of an accounting task being run by the multi-tasking microprocessor 34 implementing the above described mode of operation. Specifically, the microprocessor 34 initially clears player's account in step 45. Thereafter, the microprocessor 34 continuously executes loop 46. The first step in the loop 46 (numbered as step 47) is reading the input devices including reading of (a) the optical readers 26 (to read the identification number 24 of the transparent bingo board 23), (b) the identification key reader 28 (to read the attendant's supervisory key's identification number), and (c) the radio receiver-transmitter 31 (to acquire the start of new game command being transmitted by the central computer 39 via its receiver-transmitter 40). Following reading of the input data in step 47, the microprocessor 34 checks for the presence of valid input signals in steps 48, 49, and 50. Specifically, if the attendant's (supervisory) key 41 is identified in step 48, then the microprocessor 34 increases player's credit in step 51 (by the amount corresponding to the 'value' associated with the supervisory key 41, e.g. $20.00). If a new transparent bingo board 23 is identified, ((i.e. a new board identification number 24 is read in the step 49, then the microprocessor 34 decreases player's account (by the cost of the board 23, e.g. $1.00) in step 52). Also, if the end of game is determined in step 50 (from the information received via the radio channel 41), then the microprocessor 34 decrements the player's credit balance by the product of per board charge times number of boards 23 being played.

The keypad 30 is a convenient channel for entering information into the microprocessor 34. For example, a player may enter via the keypad 30 a secret personal identification number (PIN) to confirm that he/she is the rightful owner of the player club card shown in FIG.16. The keypad 30 may also be used for manual entering of transparent bingo board identification numbers 24 in case the optical reader 26 fails. In general, the keypad 30 may be used for entering arbitrary game related information, e.g. as disclosed in U.S. Pat. No. 4,455,025 and 4,624,462. The keypad 30 is not restricted to membrane type only and may be discrete, capacitive, infrared, etc.

The number of transparent bingo boards 23 that a single magnetic indicator board 1 can accommodate is not restricted to two only. By simply changing the size of the magnetic indicator board 1, the latter can accommodate any number of transparent bingo boards 23.

The transparent bingo boards 23 are not restricted to one specific form of carrying machine readable data. For example bar codes may be used instead of the combination of the data markings 32 with the clock markings 33. Also, the transparent bingo board may carry embedded physical means of identification, such as a smart microprocessor or another Dallas Semiconductor chip of the type DS199X.

The bingo board 23 does not have to be fully transparent. It may be opaque or transparent only in some areas, e.g. only in the immediate vicinity of the bingo numbers imprinted on the board. The bingo board 23 may also be multi-colored, e.g. bingo numbers may be imprinted in black whereas the frame delineating the bingo numbers may be imprinted in red.

Also the techniques of manufacturing the transparent bingo board 23 may vary. For example, various plastic and glass materials, not just mylar, may be used to manufacture the board 23, or several mylar sheets may be glued together to protect the bingo numbers imprinted on the inner sheet of mylar. Also printing techniques may vary and may include engraving, laser etching etc.

The LAN combining together a number of magnetic indicator boards 1 may not be restricted to one type of device assisting the player in playing bingo. For example fully automatic devices of the type disclosed in U.S. Pat. No. 4,624,462 may be included in the same network and play along with magnetic indicator boards 1. The resulting gaming network may also be linked with other similar or dissimilar networks, e.g. to provide large progressive jackpot prizes to players.

Figure 21:
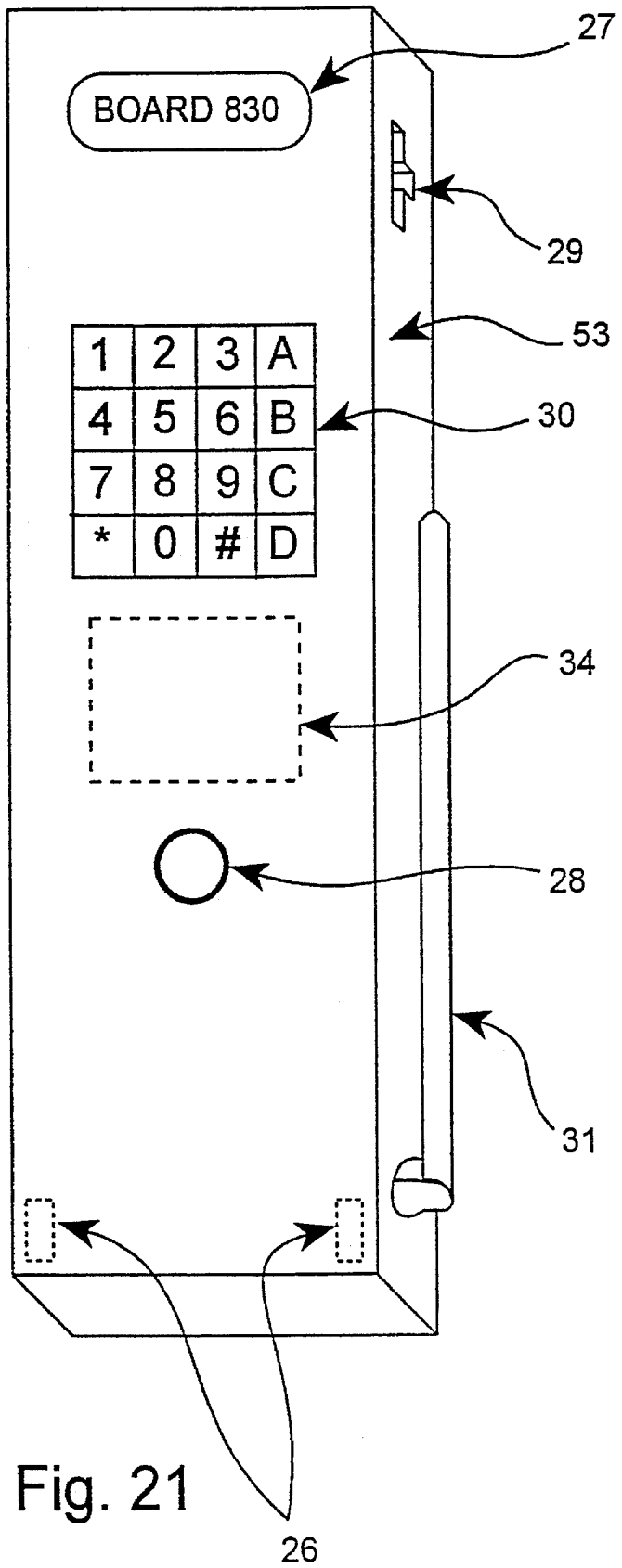
FIG. 21 shows the microprocessor module.

FIG. 13 shows the optical readers 26 housed inside (or underneath) the slides 25. However the design of the magnetic indicator board 1 shown in FIG. 13 may be simplified by placing a single pair of the optical readers 26 next to the microprocessor 34 as shown in FIG. 21, wherein the electronic module that upgrades the magnetic indicator board is shown separately and denoted 53 (such a module indeed may be manufactured as a separate unit designed to be used in conjunction with the basic magnetic indicator board shown in FIG. 1). In case of the module 53, the player has to identify the transparent bingo board 23 (that he/she wishes to play) to the microprocessor 34 by passing the board 23 through the optical reader 26 while pressing the button labeled 'B' (standing for 'Board') on the keypad 30. The pressing of this key indicates to the microprocessor 34 that the transparent bingo board 23 with the identification number 24 being read shall be registered for playing. If later on, the player decides not to play the selected transparent bingo board 23 any more, the player has to pass this board 23 through the optical readers 26 again while pressing the button labeled 'C' (standing for 'CANCEL'). This indicates to the microprocessor 34 that the board 23, with the identification number 24 being read in, is to be canceled.

Figure 22:
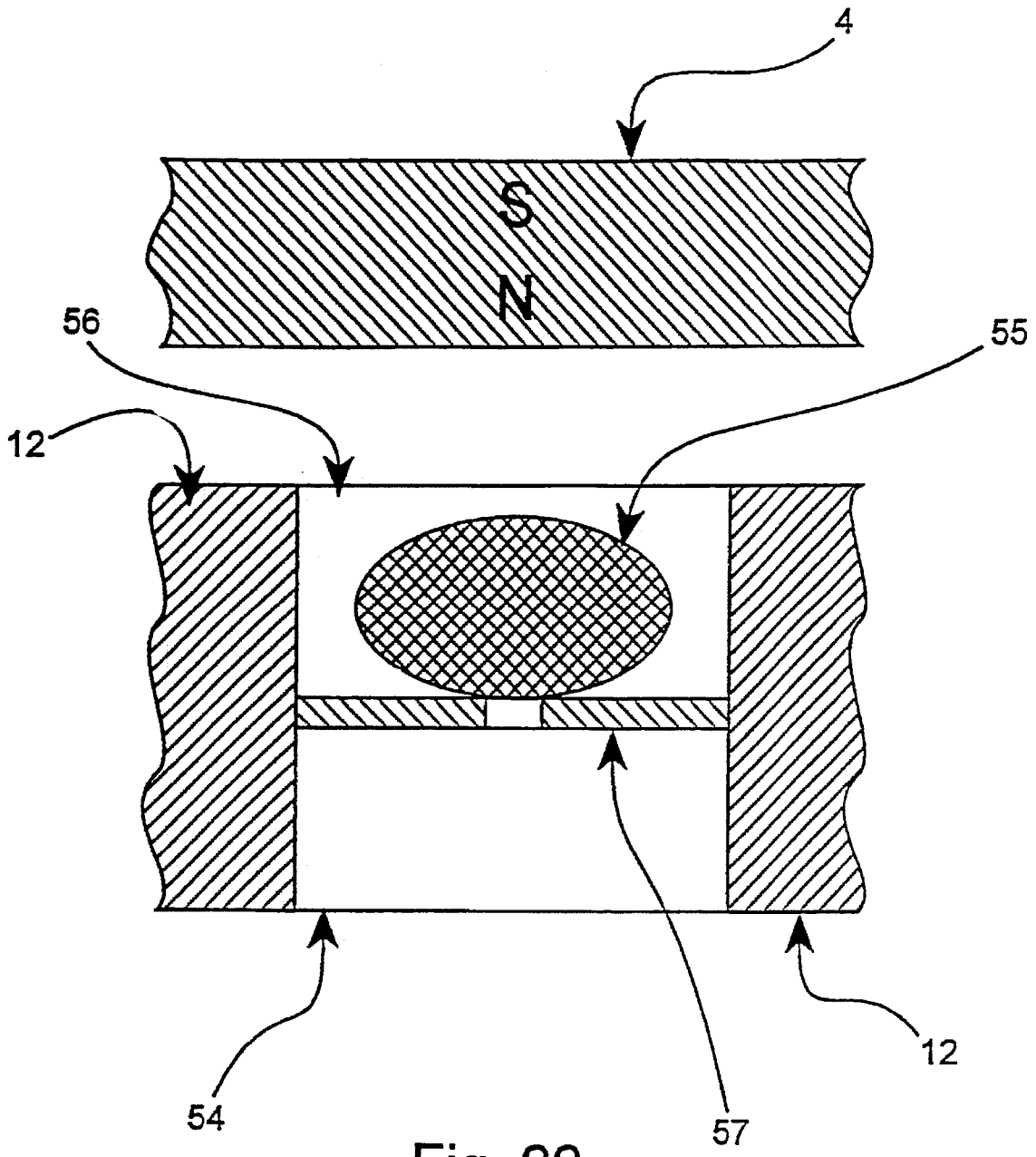
FIG. 22 shows the cross section of the single particle magnetic indicator cell.
Figure 23:
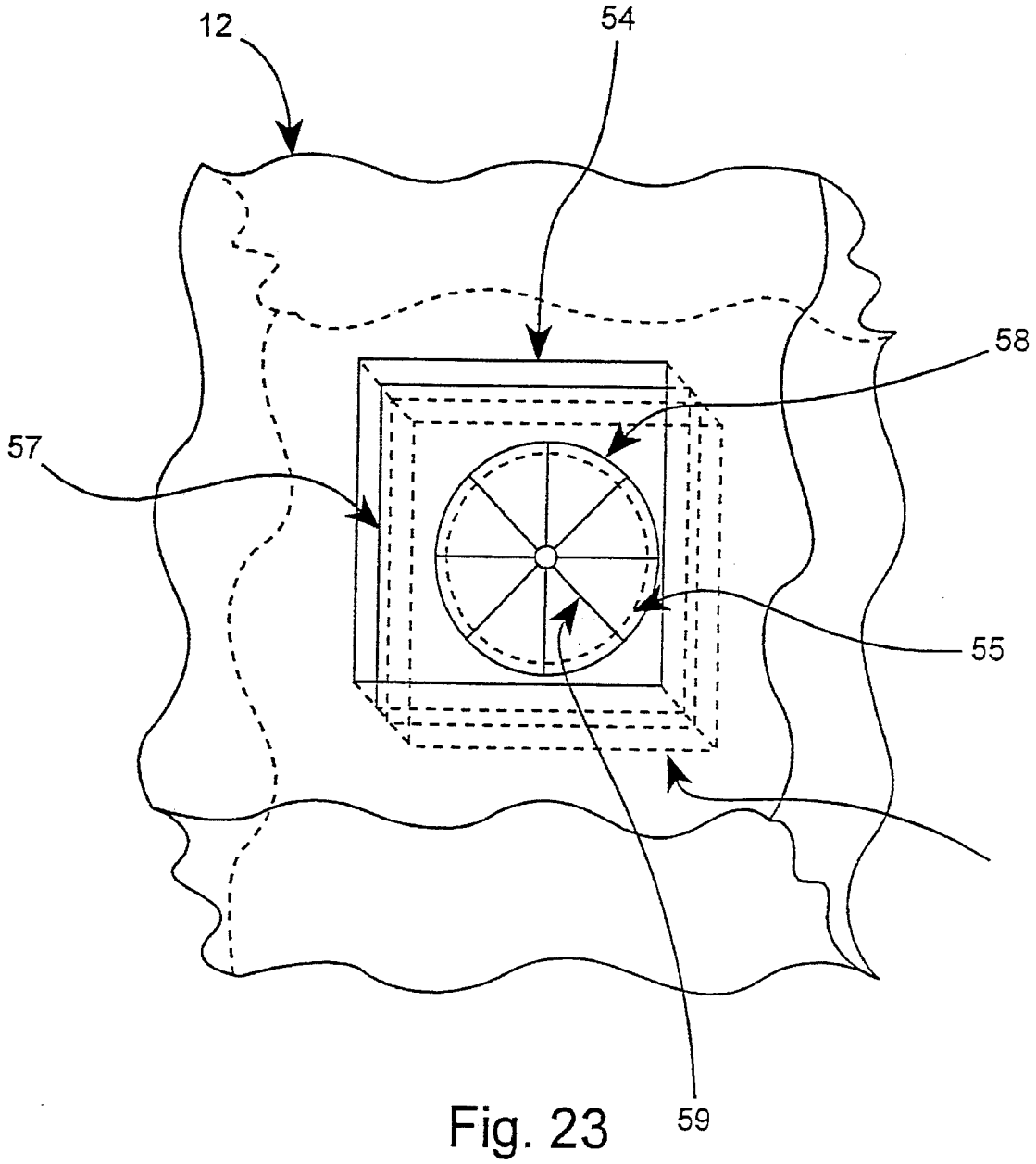
FIG. 23 shows the single particle magnetic indicator cell in the unmarked state.

The magnetic cell 15 may contain only one jumbo particle instead of a plurality of small particles as illustrated in FIG. 22, wherein 54 is a modified cell 15, 55 is a large size, but light weight, magnetic bubble (e.g. an empty plastic 'eggshell' covered with a black paint having magnetic properties). The bubble 55 is pulled into the top compartment 56 of the magnetic cell 54 by the marker magnet 4 and stays there when the marker magnet 4 is removed because it is supported by a resilient membrane shelf 57. If the marker magnet 4 is applied at the bottom of the magnetic cell 54, then the bubble 55 is pulled down into the bottom compartment and is not exposed to view from above the magnetic cell 54 as is shown in FIG. 23, wherein the resilient membrane 57 is shown to be divided in eight segments 58 by four diagonal cuts 59.

Figure 24:
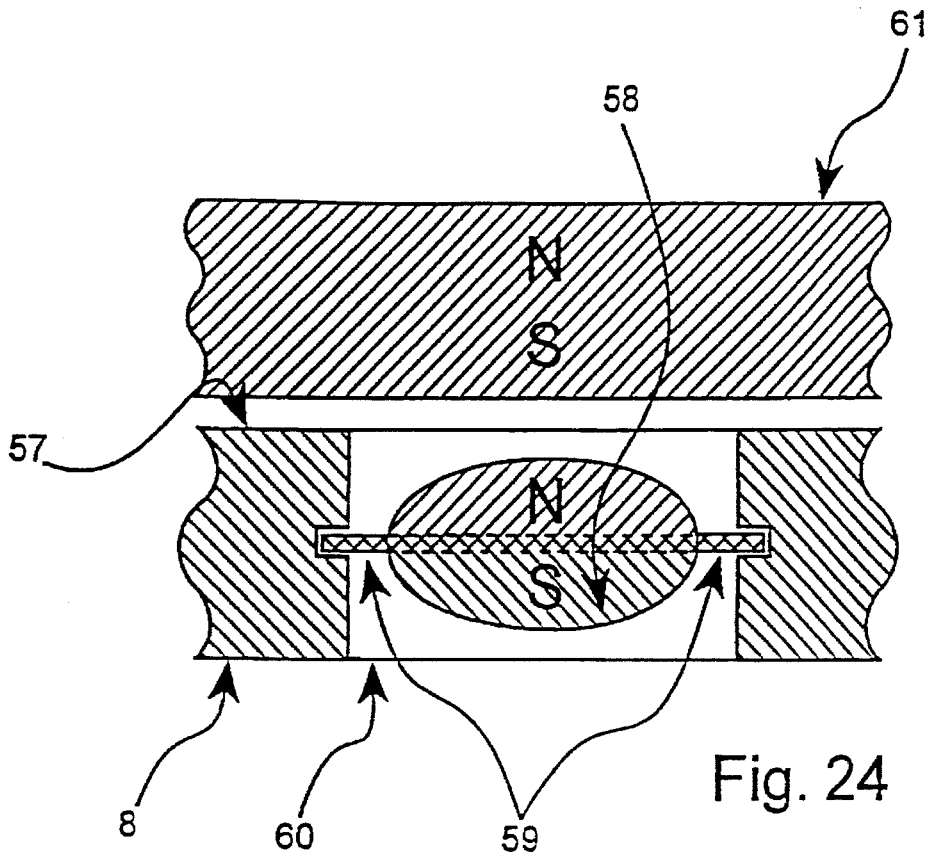
FIG. 24 shows the pivotal magnetic indicator cell in the marked state.
Figure 25:
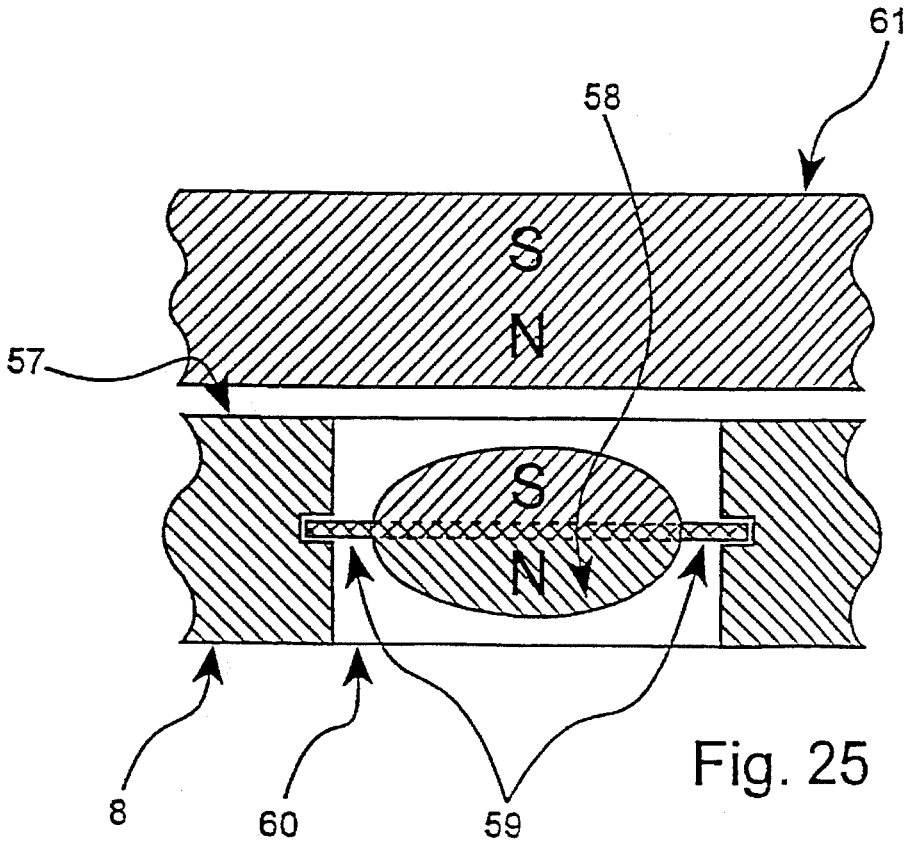
FIG. 25 shows the pivotal magnetic indicator cell in the unmarked state.

A variation of a jumbo magnetic particle technique is shown in FIG. 24, wherein 60 is a magnetic indicator cell formed by a light weight oblong indicator magnet 61 mounted on an axes 62 in the cavity 63 of the indicator panel 8. The top portion of the indicator magnet 61 is painted in black and is magnetized as the North pole, whereas the bottom portion of the indicator magnet 61 is painted in white and is magnetized as the South pole. The marker-eraser magnet 64 (shown above the magnetic indicator cell 60) forces the indicator magnet 61 to rotate around its axis 62 into the shown position. If the marker-eraser magnet 64 is removed, the indicator magnet 61 will stay in the displayed position because of the natural friction inherent in the axis 62. However if the marker-eraser magnet approaches the magnetic indicator cell 60 with the opposite position of the magnetic poles as shown in FIG. 25, then the indicator magnet 61 turns around the axis 62 and exhibits its white portion of the exterior surface to the view from the top of the magnetic indicator cell.

Also, the magnetic particles may not be free floating in the air. Rather they may be suspended in a liquid of appropriate viscosity, e.g. in the dispersing liquid having a yielding value higher than 5 dyne per centimeter square as disclosed in U.S. Pat. No. 4,143,472. In this case, the need in shelf 18 is eliminated (since the viscous liquid acts as a shelf supporting suspended particles).

Figure 26:
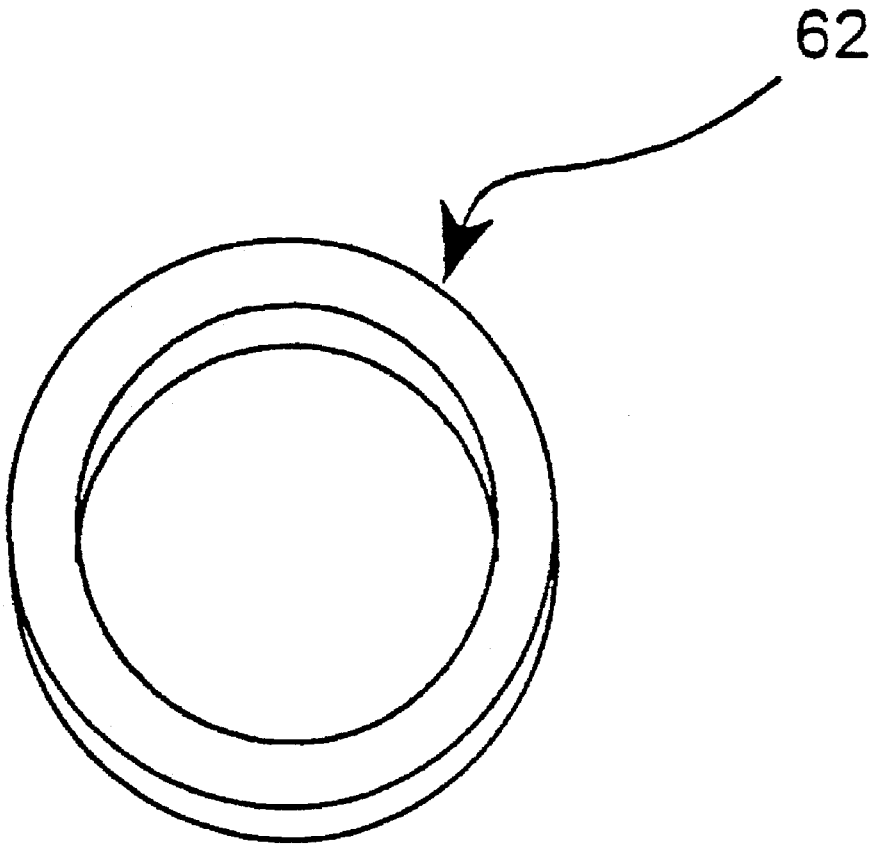
FIG. 26 shows a self-stick ring-shaped paper mask.
Figure 27:
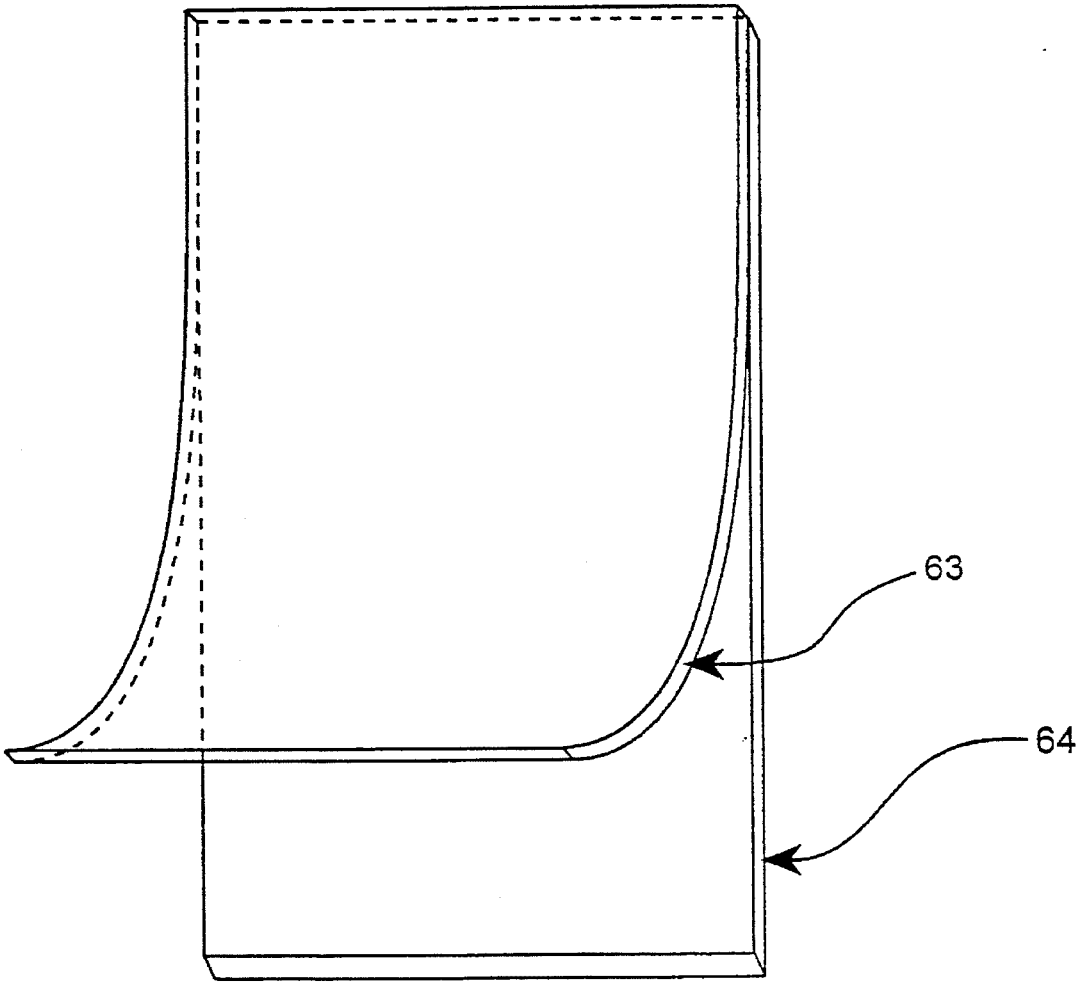
FIG. 27 shows a luminescent peal-off indicator board.

On occasion, a player may erroneously mark a number on the transparent bingo board 2. The eraser magnet 9 is not adapted for erasing an individual mark on the transparent bingo board 1 (or 23). Although various magnetic and electronic contrivances may be implemented to 'unmark' a specific number on the transparent bingo card, i.e. to erase an area of the magnetic indicator board 1 (or 23) underneath the this number, it is more convenient to temporarily affix a self-stick ring-shape nontransparent paper mask 62, such as shown in FIG. 26, on top of the desired bingo number on the transparent card. This will mask out the underlying magnetic frame 14. Instead of the self-stick paper ring 62 shown in FIG. 26, a colored semitransparent circular marker may be used as well and many other forms and shapes of objects which mask out a portion of the magnetic indicator board. Utilization of magnetic phenomena is not the only available method of nonelectronic marking and unmarking symbols on the transparent bingo boards 1 and 23. Other nonelectronic techniques of touch responsive displaying may also be beneficial. In particular, the luminescent writing and displaying techniques, such as disclosed in U.S. Pat. No. 4,988,301 and 4,927,748 are helpful. The latter techniques allow one to change the visible appearance of a bingo number on the transparent cards 1 and 23 by simply applying pressure (e.g. with a finger or a writing wand) to the luminescent display. At the end of the game, the entire luminescent display may be easily erased by pealing off the top sheet of the display as shown in FIG. 27, wherein 63 is the top, peal-off layer of the indicator board (filled with an opaque misplacable substance), and 64 is the stationary (nontransparent substrate) layer of the luminescent indicator board.

Although only the bingo game was described above in detail, the magnetic indicator board 1 may be also beneficial for playing various other games akin to bingo. For example, by simple modification of the transparent bingo board 23, the magnetic indicator board can be adjusted to play British 90-number bingo, or a French 30 number bingo. Also a 80-number game of keno can be easily implemented with the help of a board of a magnetic indicator board as displayed in FIG. 1.

What is claimed is:

1. A method of marking an at least partially transparent game card including the steps of (a) superimposing said gaming card on a magnetic indicator board containing at least one magnetically responsive movable body, (b) applying a magnetic field in the vicinity of a gaming symbol on said gaming card, and (c) changing the visual appearance of the front side of said magnetic indicator board in the vicinity of said gaming symbol due to repositioning of said magnetically responsive physical body within said magnetic indicator board in the vicinity of said gaming symbol caused by said magnetic field.

2. A method of claim 1 further including a step of restoring the original visual appearance of the front side of said magnetic indicator board by application of a magnetic field at the back side of said magnetic indicator board.

3. A method of claim 1 further including a step of restoring the original visual appearance of the front side of said magnetic indicator board by application of a magnetic field of opposite polarity in the vicinity of said symbol.

4. A method of claim 1 further including a step of accounting for said gaming card through inputting of local game relevant information including data identifying said game card into a local data processing means.

5. A method of claim 4 further including a step of communicating said local game relevant information from said local data processing means to a remote data processing means.

6. A method of claim 4, wherein said local game relevant information includes at least one of the following (a) data identifying the person using said method, and (b) credit authorization data.

7. A method of claim 1 further including a step of receiving and processing global game relevant information originating at a remote data processing means.

8. A method of claim 1 further including a step of unmarking said symbol by placing a masking object on top of said game card in the vicinity of said symbol.

9. A method of claim 1, wherein said game card comprises a bingo card.

10. A method of marking an at least partially transparent gaming card carrying at least one game symbol including the steps (a) superimposing said gaming card on an indicator board comprised of at least one sealed compartment with at least partially opaque dispalceable substance, (b) applying a physical force through said gaming card in the vicinity of said gaming symbol, (c) transferring said physical force to said displaceable substance, and (d) changing the visual appearance of said indicator board in said area in response to application of said force due to displacing of said movable substance.

11. A method of claim 10, wherein said physical force is at least one of the following (a) magnetic force, and (b) mechanical force.

12. A method of claim 11 further including a step of placing a masking object on said game card to unmark said game symbol.

13. A method of claim 11, wherein said game card comprises a bingo card.

14. A method of claim 10, wherein said indicator board includes a local data processing means; said local data processing means performing a further step of inputting local game relevant information including at least one of the following (a) data identifying said game card, (b) data identifying the person using said magnetic indicator board, and (c) credit authorization data.

15. A method of claim 14, wherein said local data processing means further performs a step communicating said local game relevant information to a remote data processing means.

16. A method of claim 15, wherein said local data processing means further performs the step of communicating accumulated accounting information to said remote data processing means upon completion of a sequence of games.

17. A method of claim 14, wherein said local data processing means further performs a step of receiving and processing global game relevant information originating at a remote data processing means.

18. A method of claim 17, wherein said local data processing means further performs a step of calculating an increase in an account balance resulting from said inputting of said local game relevant information into said local data processing means, and a decrease in said account balance resulting from said receiving and processing of said global game relevant information by said local data processing means.

19. A method of claim 14 further including a step of inputting at least a portion of said local game relevant information into said local data processing means via an optical reading means.

20. A method of claim 14, wherein said physical force is a magnetic force.

* * * * *